US010226122B2

(12) United States Patent
Booth et al.

(10) Patent No.: US 10,226,122 B2
(45) **Date of Patent: *Mar. 12, 2019**

(54) APRON-FRONT SINK

(71) Applicant: Kohler Co., Kohler, WI (US)

(72) Inventors: Shawn J. Booth, Sheboygan, WI (US); James S. Giefer, Sheboygan, WI (US)

(73) Assignee: KOHLER CO., Kohler, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/922,847

(22) Filed: Oct. 26, 2015

(65) Prior Publication Data

US 2016/0040406 A1 Feb. 11, 2016

Related U.S. Application Data

(63) Continuation of application No. 13/310,460, filed on Dec. 2, 2011, now Pat. No. 9,173,487.

(60) Provisional application No. 61/449,585, filed on Mar. 4, 2011.

(51) Int. Cl.

| | |
|---|---|
| ***A47B 77/06*** | (2006.01) |
| ***E03C 1/18*** | (2006.01) |
| ***A47B 77/02*** | (2006.01) |
| ***E03C 1/33*** | (2006.01) |
| ***E03C 1/186*** | (2019.01) |

(52) U.S. Cl.

CPC ..... *A47B 77/06* (2013.01); *A47B 77/022* (2013.01); *E03C 1/18* (2013.01); *E03C 1/186* (2013.01); *E03C 1/33* (2013.01)

(58) Field of Classification Search

CPC ..... A47B 77/022; A47B 77/06; A47B 77/08
USPC ..... 4/630–637; D23/272–274, 284, 286, D23/292–293.1, 303, 307
See application file for complete search history.

(56) References Cited

U.S. PATENT DOCUMENTS

| | | | |
|---|---|---|---|
| 94,501 | A | 9/1869 | Morahan |
| 893,716 | A | 7/1908 | Gain |
| 1,880,733 | A | 10/1932 | Bolhuis |
| 2,023,692 | A | 12/1935 | McQuinn |
| 2,441,563 | A | 5/1948 | Clark |
| 2,505,828 | A | 5/1950 | Fox |
| 3,051,160 | A | 8/1962 | Nielsen |

(Continued)

FOREIGN PATENT DOCUMENTS

| | | |
|---|---|---|
| BE | 483814 | 7/1948 |
| CN | 2518919 | 10/2002 |

(Continued)

OTHER PUBLICATIONS

Screen capture from Dawn USA showing HTML coding with product installation manual date. Retrieved from http://dawnusa.net/productsee/4. Screen capture from amazon.com showing earliest available date of sink model DAF3320C.*

Results from STIC search, dated Oct. 12, 2018.*

Chinese Notification of First Office Action dated Jun. 25, 2014 for Application No. 201280021385.9, 9 Pages.

International Preliminary Report on Patentability and Written Opinion Regarding Application No. PCT/US2012/027306 dated Sep. 10, 2013.

(Continued)

*Primary Examiner* — Erin Deery
(74) *Attorney, Agent, or Firm* — Foley & Lardner LLP

(57) ABSTRACT

An apron-front sink includes a basin, a rim located at an upper portion of the basin, and an apron comprising a front member. The front member extends downward from the rim and laterally between a first end and an opposite second end. The first and second ends of the apron extend outwardly beyond the rim such that the apron is wider than the basin and the rim.

19 Claims, 14 Drawing Sheets

(56) References Cited

U.S. PATENT DOCUMENTS

| | | | | |
|---|---|---|---|---|
| 3,142,295 | A | 7/1964 | Blee | |
| 3,813,706 | A * | 6/1974 | Williams | A47K 1/04 264/309 |
| 4,878,257 | A | 11/1989 | Hardin | |
| D313,068 | S | 12/1990 | Kohler et al. | |
| 5,070,554 | A | 12/1991 | Bertoli | |
| 5,199,119 | A | 4/1993 | Weber | |
| D353,652 | S | 12/1994 | Dannenberg | |
| D358,457 | S * | 5/1995 | Dannenberg | D23/293.1 |
| D445,488 | S | 7/2001 | Katz et al. | |
| D451,585 | S * | 12/2001 | Svendsen | D23/290 |
| 6,564,398 | B1 | 5/2003 | Trott | |
| 7,007,317 | B1 | 5/2006 | Brown | |
| 7,246,387 | B2 | 7/2007 | Erickson et al. | |
| D558,311 | S | 12/2007 | Adams | |
| D560,773 | S | 1/2008 | Kitzmiller | |
| D624,634 | S | 9/2010 | Thomas | |
| 2005/0263657 | A1 | 12/2005 | Demel | |
| 2006/0195981 | A1 | 9/2006 | Yemini | |
| 2008/0313803 | A1 | 12/2008 | Osterroth et al. | |

FOREIGN PATENT DOCUMENTS

| | | |
|---|---|---|
| CN | 200988983 | 12/2007 |
| DE | 8535539 | 2/1986 |
| DE | 102006006404 | 8/2007 |
| EP | 1598489 | 11/2005 |
| FR | 2632838 | 12/1989 |
| JP | 09316955 | 12/1997 |
| JP | 2010154990 | 7/2010 |

OTHER PUBLICATIONS

International Search Report and Written Opinion dated Aug. 28, 2012 Regarding Application No. PCT/US2012/027306.
International Search Report Regarding Application No. PCT/US2012/027318 dated Sep. 10, 2013.
International Search Report Regarding Application No. PCT/US2012/027303 dated Sep. 10, 2013.
Mott'S Plumbing Fixture; Plate 7078; 1 Page.
Dawn, Catalog, 2009, (79 pages).
Dawn Kitchen & Bath Products, Inc., Installation Instructions Apron Front Sinks, Copyright 2011, unknown what date in 2011 this may have been publically available, (6 pages).
Dawn, Brochure, Believed to be available as of May 2010, (2 pages).
Kohler, Dickinson Product Drawing 91517, Jun. 1991, (3 pages).
Elkay, Residential and Commercial Sinks, Faucets & Accessories, Oct. 2004, (5 pages).
Franke Style, Manor House sinks, Copyright 2002, (4 pages).
Kohler, Hawthorne Product Drawing 91516-AA, Jun. 1991, (3 pages).
Elkay, Custom Kitchens and Baths, Copyright 2005, (5 pages).
Franke, Manor House Sinks, 2002 (1 page).
Kohler, Hawthorne Apron Front Kitchen Sink, Specification Sheet, First Available Sep. 2004 (2 pages).
Kohler, Dickinson Apron Front Kitchen Sink, Specification Sheet, First Available Sep. 2004 (2 pages).
Mirabelle, Mirabelle Apron Front Stainless Steel Sink Installation Instructions, Copyright 2011, (4 pages).

* cited by examiner

SECTION B-B

SECTION A-A

APRON-FRONT SINK

CROSS-REFERENCE TO RELATED PATENT APPLICATIONS

This application is a continuation of U.S. patent application Ser. No. 13/310,460, filed Dec. 2, 2011, which claims the benefit of and priority to U.S. Provisional Application No. 61/449,585, filed Mar. 4, 2011, the entire disclosures of which are incorporated by reference herein.

BACKGROUND

The present disclosure relates generally to the field of sinks. More specifically, the present disclosure relates to the field of apron-front sinks.

Sinks are vessels generally configured for receiving water. Usually, a faucet or other water source is located proximate to the sink, and a drain pipe is coupled to the sink to remove unwanted water. A sink is often mounted on or into a cabinet, stand, or pedestal. A sink may be mounted such that a rim of the sink rests on a countertop of a cabinet. This is generally referred to as self-rimming. Alternatively, a sink may be mounted such that the rim of the sink is located below the countertop. This is generally referred to as under-counter mounted or under-mounted.

Apron-front sinks, which include farmhouse sinks, have an exposed panel extending laterally across a front portion of the sink. One continuing challenge in the field of apron-front sinks relates to fitting the sink into the cabinet. Installation of an apron-front sink usually requires precise and repeated cuts to fit the sink to the front of the cabinet without leaving unsightly gaps between the apron and the cabinet. This custom fitting method takes time and requires an installer to repeatedly lift a heavy sink to check for fit.

Another continuing challenge in the field of apron-front sinks relates to retrofitting. Usually apron-front sinks will not fit into standard, stock, or off-the-shelf non-apron-front cabinetry due to the width of the sink and the height of the cabinet's lower doors. Alternatively, such retrofits require extensive modifications to the cabinet or installation of an undersized sink.

SUMMARY

One embodiment relates to a sink. The sink includes a basin having a first side wall, an opposite second side wall and a front wall. The sink also includes a rim supported at and extending outwardly from an upper end of the first and second side walls in a substantially horizontal orientation. The sink further includes an apron extending vertically below the rim and laterally between a first end and an opposite second end to define a front portion of the sink. The first end of the apron extends outwardly past the rim associated with the first side wall and the second end of the apron extends outwardly past the rim associated with the second side wall.

Another embodiment relates to a sink. The sink includes a basin having a first side wall, an opposite second side wall and a front wall. The sink also includes a rim supported at and extending outwardly from an upper end of the first and second side walls in a substantially horizontal orientation. The sink further includes an apron coupled to the rim and extending vertically below the rim. The apron extends laterally between a first end and an opposite second end to define a front portion of the sink. The front wall of the basin is angled downwardly and rearwardly from the rim to a floor of the basin.

Another embodiment relates to a sink assembly. The sink assembly includes a cabinet having a front wall defining a recess and a sink supported by the cabinet and received by the recess. The sink includes a basin having a first side wall, an opposite second side wall and a front wall. The sink also includes a rim supported at and extending outwardly from an upper end of the first and second side walls in a substantially horizontal orientation. The sink further includes an apron extending vertically below the rim and laterally between a first end and an opposite second end to define a front portion of the sink. The first end of the apron extends outwardly past the rim associated with the first side wall and the second end of the apron extends outwardly past the rim associated with the second side wall.

DETAILED DESCRIPTION

Figure 1:
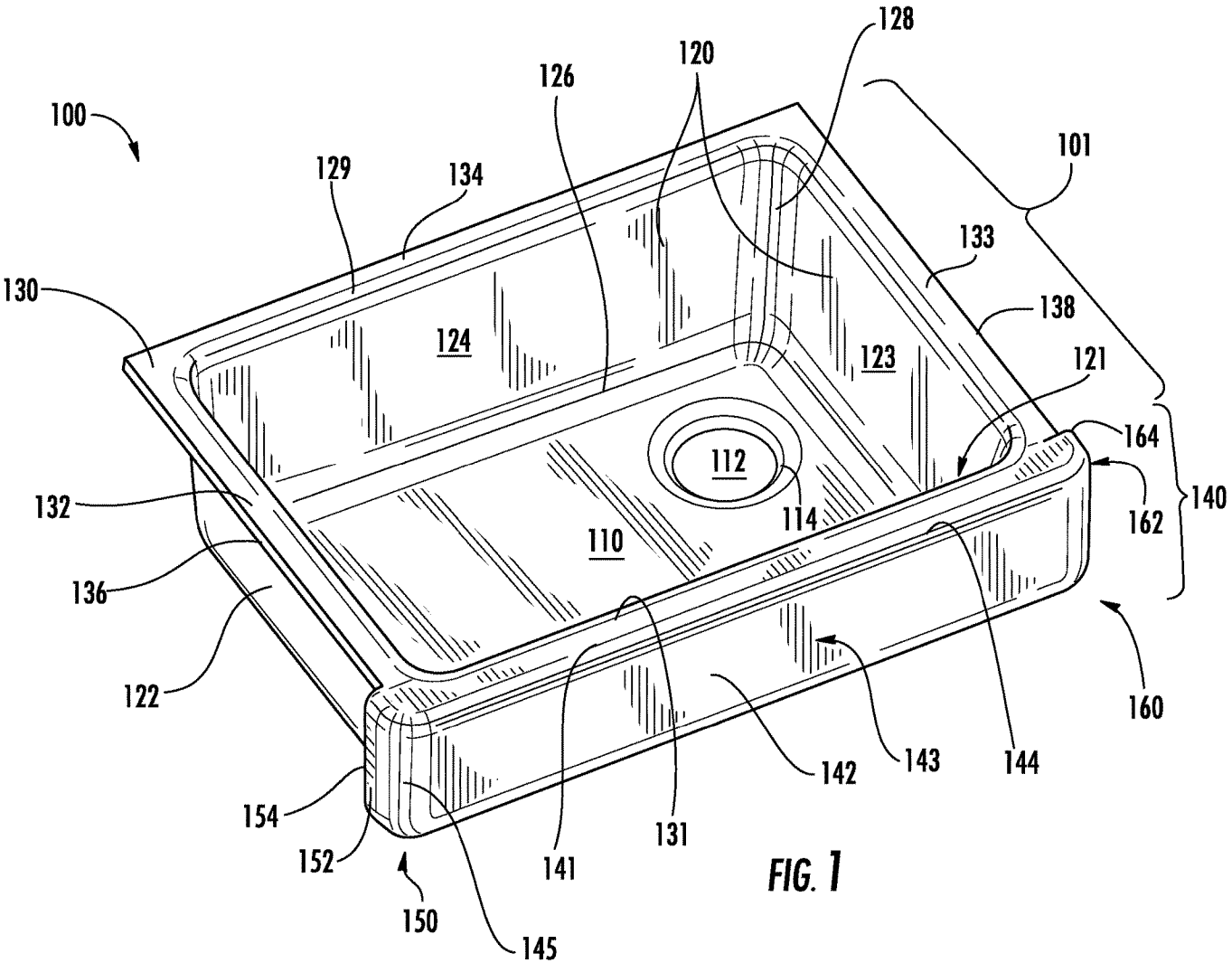
FIG. 1 is a perspective view of a sink, shown according to a first exemplary embodiment.

Referring generally to the FIGURES, sinks and components thereof are shown according to exemplary embodiments. The sinks may be installed in various environments including a kitchen or bathroom. The sinks are designed to replace and/or be installed in instead of a conventional sink to provide a user with the appearance of a traditional apron front or farmhouse sink without requiring significant modifications to the cabinetry or other support structures that may otherwise be required for traditional apron front and farmhouse sinks.

The sinks generally include one or more basins and a front apron coupled to the one or more basins. The one or more basins are defined by a floor and one or more sidewalls extending upwardly from the floor. The sink may have any number of basins. For example, the sink may have one, two, or more basins. Alternatively, the sink may have a single basin divided into two or more reservoirs. The basins or reservoirs may be separated by one or more dividers (e.g., separator, structure, hump, ridge, etc.), such as a saddle. The saddle may be of any height, but preferably remains below the rim plane of the sink. The saddle may divide the sink into multiple equal or unequal sized basins or reservoirs.

The sinks also include a flange or rim outwardly extending from a top edge or portion of the sidewalls. The apron, which is coupled to the front wall of the basin via the same or similar rim, extends downwardly from the rim and laterally between a first end and a second end to define a front portion of the sink. The first and second ends of the apron extend laterally beyond the outer periphery of the rim associated with each corresponding side wall. Extending the ends of the apron past the outer periphery of the rim may allow the ends of the apron to at least partially overlap a face of the cabinetry to conceal possible cut lines and/or openings in the face of the cabinetry.

Before discussing further details of the sinks and/or the components thereof, it should be noted that references to "front," "back," "rear," "upper," "lower," "right," and "left" in this description are merely used to identify the various elements as they are oriented in the FIGURES, with "right," "left," "front," "back," and "rear" being relative to a user facing the sink, and with "lateral" being left-right as viewed by the user. These terms are not meant to limit the element which they describe, as the various elements may be oriented differently in various applications.

It should further be noted that for purposes of this disclosure, the term coupled means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

Referring to FIGS. 1-6, a sink 100 is shown according to an exemplary embodiment. Sink 100 includes at least one receptacle for receiving and/or holding water (e.g., a reservoir, washbasin, bowl, etc.), shown as a basin 101. Basin 101 may have a variety of shapes, for example, circular, oval, polygonal, or sections of the shapes thereof (e.g. circle sector). According to the embodiment shown, basin 101 is substantially rectangular with a lateral width dimension (i.e., side-to-side) being greater than the depth dimension (i.e., front-to-back).

Basin 101 is shown as including a floor 110. Floor 110 may have a variety of shapes and textures. Floor 110 defines one or more apertures, shown as drain 112, that allows water to be removed from basin 101. As shown, drain 112 is substantially circular and located in rear right portion of floor 110. According to the various alternative embodiments, drain 112 may be non-circular and may be located elsewhere in the floor (e.g., in a front portion, a left portion, a rear portion, a right portion, centrally, or some combination thereof, etc.). Drain 112 is shown as being defined by a lip 114. Drain 112 may be coupled to a drain pipe and/or a garbage disposal mechanism, which is in turn coupled to a municipal sewerage system or to a septic system. According to an exemplary embodiment, floor 110 is sloped towards drain 112 such that water in basin 101 flows toward drain 112 by gravitational force. According to the various alternative embodiments, the sidewalls of basin 101 may be continuously curved such that no discernable floor is formed.

Basin 101 is also shown as including a plurality of sidewalls (generically referred to together as sidewalls 120) which extend generally upwardly from floor 110. According to the embodiment illustrated, basin 101 includes a front sidewall 121 (e.g., the sidewall of the front portion), a left sidewall 122, a right sidewall 123, and a rear sidewall 124. Front sidewall 121 extends laterally across a front portion of basin 101, rear sidewall 124 extends laterally across a rear portion of basin 101, left sidewall extends front-to-back between front sidewall 121 and rear sidewall 124 along a first side portion of basin 101 (e.g., a left side portion) and right sidewall 123 extends front-to-back between front sidewall 121 and rear sidewall 124 along a second side portion of basin 101 (e.g., a right side portion, etc.).

Figures 3, 4:
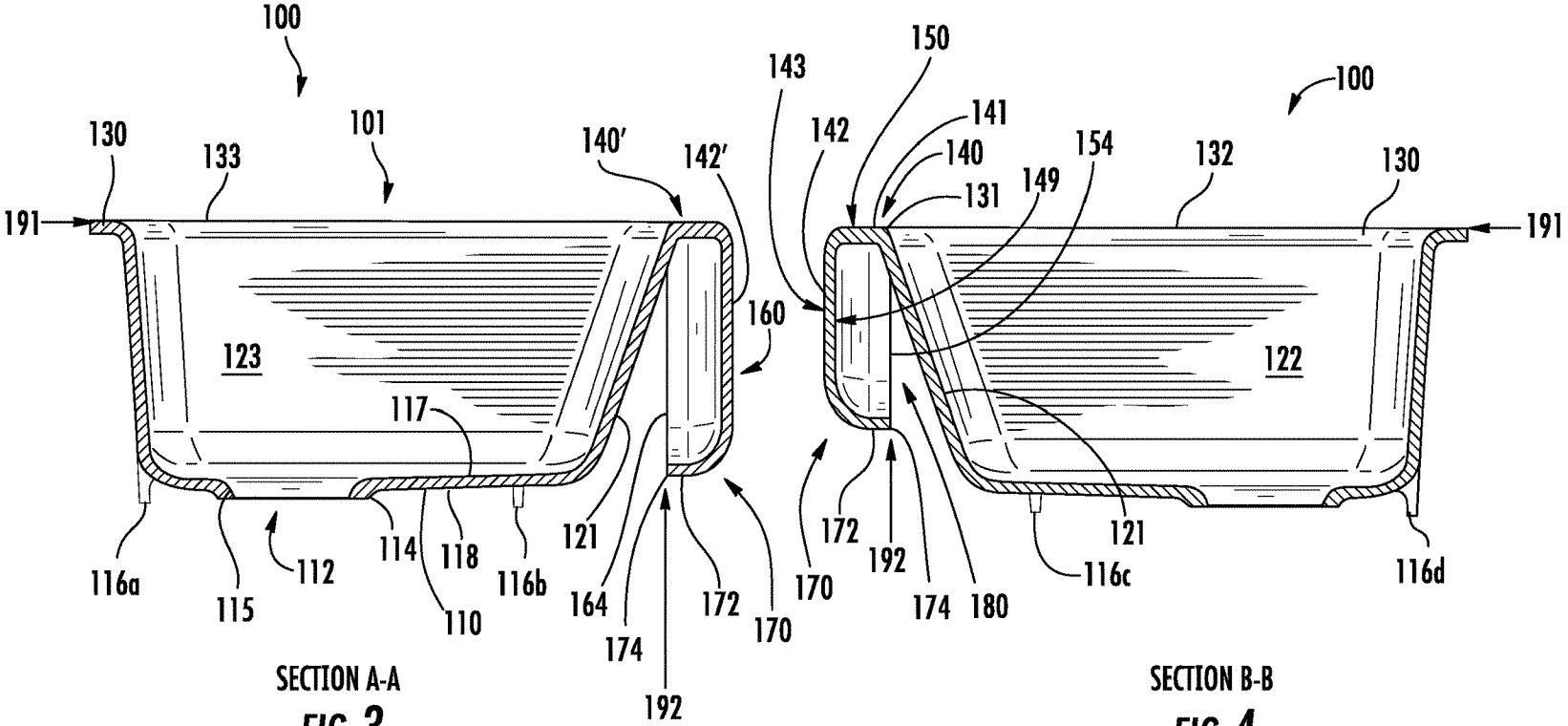
FIG. 3 is a cross-sectional view through Section A-A of the sink of FIG. 1, shown according to an exemplary embodiment.
FIG. 4 is a cross-sectional view through Section B-B of the sink of FIG. 1, shown according to an exemplary embodiment.

According to an exemplary embodiment, sidewalls 120 are coupled to floor 110 at generally rounded corners which provide continuous surface transitions. For example, rear sidewall 124 couples floor 110 at bottom basin corner 126. Bottom basin corner 126 is shown to be continuously curved. As shown in FIGS. 3 and 4, the transition between sidewall 120 and floor 110 is generally concave. According to the various alternative embodiments, the this transition region may be angled and/or have discontinuously curved surface transitions from floor 110 to sidewall 120. The rounded corners for each of corners floor 110 to front sidewall 121, floor 110 to left sidewall 122, floor 110 to right sidewall 123, and floor 110 to rear sidewall 124 may have the same or different radii of curvature.

Figure 2:
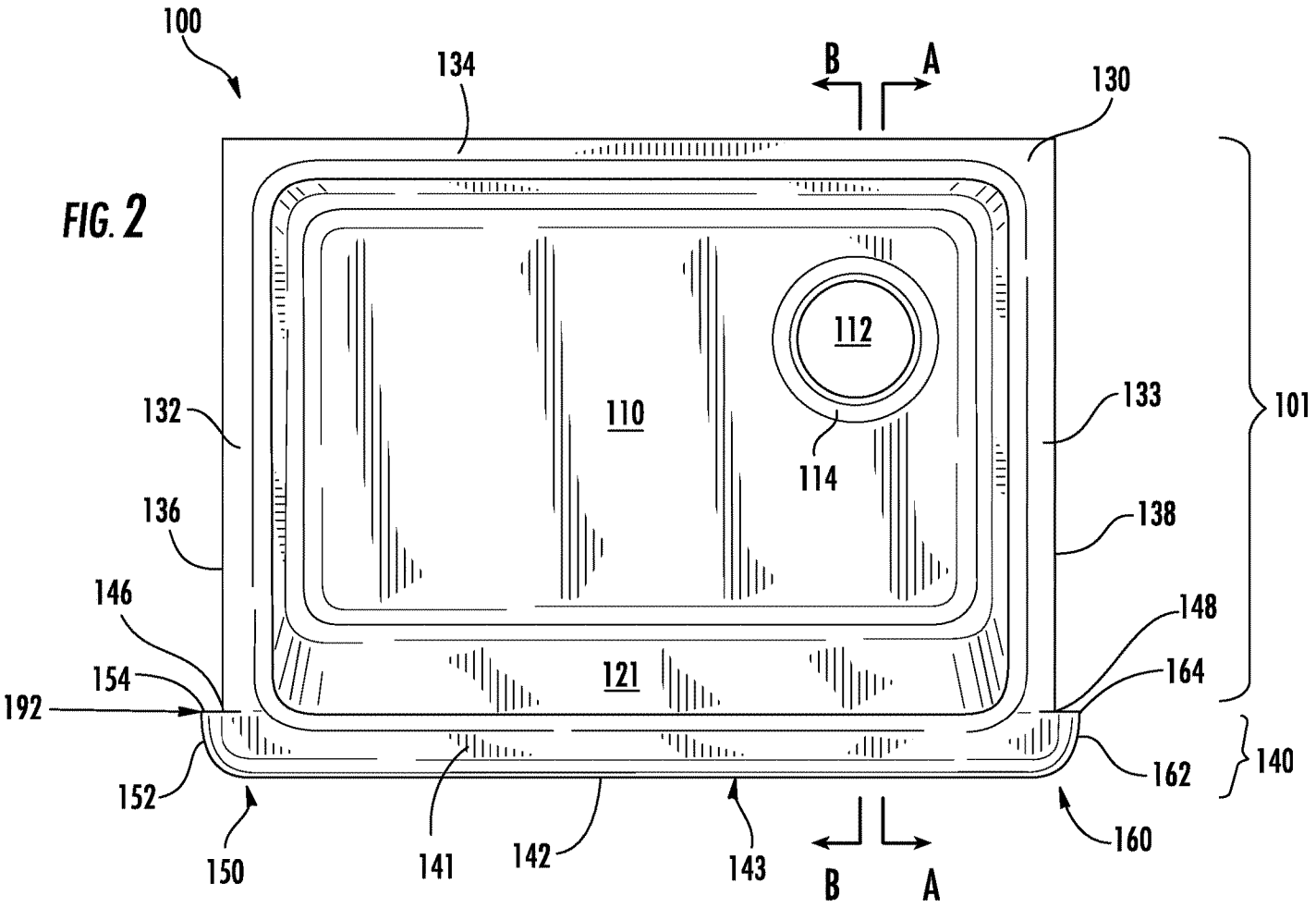
FIG. 2 is a top planar view of the sink of FIG. 1, shown according to an exemplary embodiment.

According to an exemplary embodiment, sidewalls 120 are coupled to each other at generally rounded corners which provide continuous surface transitions. For example, right sidewall 123 is shown to couple rear sidewall 124 at side basin corner 128. Side basin corner 128 is shown to be continuously curved. As shown in FIG. 2, the transition between adjacent sidewalls 120 is generally concave. According to the various alternative embodiments, this transition region may be angled and/or have discontinuously curved surface transitions between adjacent sidewalls 120. The rounded corners for each of corners front sidewall 121 to left sidewall 122, left sidewall 122 to rear sidewall 124, rear sidewall 124 to right sidewall 123, and right sidewall 123 to front sidewall 121 may have the same or different radii of curvature.

Basin 101 is further shown as including one or more flanges or rims (generically referred to as a rim 130) that at least partially define an outer and/or upper periphery of basin 101. Rim 130 is shown as being provided at a top edge or portion of sidewall 120 and extending generally outwardly (i.e., in a direction opposite the center of the sink) therefrom. According to the embodiment illustrated, basin 101 includes a front rim 131, a left rim 132, a right rim 133, and a rear rim 134. Front rim 131 extends outwardly from a top edge or portion of front sidewall 121, left rim 132 extends outwardly from a top edge or portion of left sidewall 122, right rim 133 extends outwardly from a top edge or portion of right sidewall 123, and rear rim 134 extends outwardly from a top edge or portion of rear sidewall 124. The thickness of rim 130 may be the same or different than the thickness of sidewall 120. Further, the individual thicknesses of each of front rim 131, left rim 132, right rim 133, and/or rear rim 134 may be the same or different. The individual widths of each of front rim 131, left rim 132, right rim 133, and/or rear rim 134 may also be the same or different. According to the embodiment illustrated, left rim 132 and right rim 133 have a substantially similar width, which is larger than the width of rear rim 134. Providing a narrower rear rim 134 may provide additional clearance for faucets, soap dispensers, etc. that are likely to be mounted behind the sink. Providing a wider left rim 132 and right rim 133 may provide additional surface areas for mounting the sink to an underside of a countertop as detailed below. Front rim 131, left rim 132, right rim 133, and rear rim 134 are shown to form a continuous rim surface. According to alternative embodiments, rim 130 may be formed of discontinuous rim segments.

According to an exemplary embodiment, sink 100 is configured to be supported by rim 130. For example, sink 100 may be supported by an underside surface of rim 130, such as by having rim 130 rest on top of a countertop or any other suitable support surface. According to an exemplary embodiment, sink 100 is configured to be supported by having a bottom portion of rim 130 directly engage the support structure. According to another embodiment, rim 130 may be supported against a bottom surface of a countertop. For example, a top surface of rim 130 may be coupled to a bottom surface of a countertop or support structure via one or mechanical fasteners and/or an adhesive.

According to an exemplary embodiment, each rim 130 is coupled to each adjacent sidewall 120 at generally rounded corners which provide continuous surface transitions. For example, rear rim 134 is shown to as being coupled to rear sidewall 124 at top basin corner 129, which is shown to be continuously curved. As shown in FIGS. 3 and 4, the transition between rim 130 and the corresponding sidewall 120 is generally convex. According to alternative embodiments, this transition region may be angled and/or have discontinuously curved surface transitions from rim 130 to adjacent sidewall 120. The rounded corners for each of corners front rim 131 to front sidewall 121, left rim 132 to left sidewall 122, right rim 133 to right sidewall 123, and rear rim 134 to rear sidewall 124 may have the same or different radii of curvature.

Rim 130 defines a first plane (e.g., top plane), shown as rim plane 191 (see FIGS. 3 and 4). According to the embodiment illustrated, front rim 131, left rim 132, right rim 133 and/or rear rim 134 cooperate to define rim plane 191. According to the exemplary embodiment, rim panel 191 is a generally horizontal plane. Rim 130 may be sloped slightly inward so that any fluid collected on the rim will be directed towards basin 101 and ultimately towards drain 112. For example, a portion of rim 131 proximate sidewall 121 may be lower than a portion of rim 131 distal sidewall 121. According to the embodiment illustrated, front rim 131 is supported at an angle of approximately 2 degrees relative to rim plane 191, but according to the various alternative embodiments, may be supported at angles greater or less than the example provided.

Referring back to FIG. 2, left rim 132 has a first edge, shown as left rim edge 136, and right rim 133 has a second edge, shown as right rim edge 138. Left rim edge 136 and/or right rim edge 138 may at least partially define an outer periphery of basin 101. According to an exemplary embodiment, the distance from left rim edge 136 to right rim edge 138 is approximately 34 inches, and the distance from left sidewall 122 to right sidewall 123 is approximately 31 inches. According to another exemplary embodiment, left rim edge 136 and right rim edge 138 are approximately 31 inches apart, for a reservoir that has a width of approximately 28 inches. According to the embodiment illustrated, left rim edge 136 and right rim edge 138 are approximately 28 inches apart for a reservoir that has a width of approximately 25 inches. According to various alternative embodiments, the rim may be sized to be greater or less than the dimensions provided above.

Referring back to FIGS. 1 and 2, apron 140 extends laterally across a front portion of basin 101 to define a front portion of the sink that is configured to be visible to a user when installed. As shown, apron 140 is coupled to the basin 101 and is supported at a substantially vertical orientation. According to an exemplary embodiment, apron 140 includes a first surface (e.g., structure, member, etc.), shown as top flange 141, a second surface (e.g., structure, member, etc.), shown as front face 142, a first end surface, shown as left end portion 150, and a second end surface, shown as right end portion 160. Left end portion 150 is shown as being located laterally opposite of right end portion 160.

Top flange 141 extends outwardly in a forward direction from front sidewall 121 and front rim 131. According to various embodiments, a top surface of apron 140 may be substantially defined by top flange 141, rim 131, or any combination thereof. According to the embodiment illustrated, the transition from top flange 141 to front rim 131 is substantially continuous. Similarly, the transition from top flange 141 to left rim 132, and the transition from top flange 141 to right rim 133, is also substantially continuous. According to an exemplary embodiment, front face 142 extends generally downwardly from top flange 141 in a vertical direction.

Top flange 141 is shown to extend laterally to left end portion 150 and to right end portion 160. Left end portion 150 and right end portion 160 form extension or wing portions that are configured to at least partially overlap or cover a portion of the cabinetry or other structure upon which the sink is supported. Left end portion 150 includes an end surface, shown as left end surface 152 that extends generally rearwardly. Left end surface 152 has a rear edge 154 that is configured to abut or be positioned adjacent a front face of the cabinetry supporting sink 100. According to the embodiment illustrated, left end surface 152 and/or rear edge 154 define a lateral extremity of apron 140 and a rearward extremity of left end portion 150. Similarly, right end portion 160 includes an end surface, shown as right end surface 162 that extends generally rearwardly. Right end surface 162 has a rear edge 164 that is configured to abut or be positioned adjacent a front face of the cabinetry supporting sink 100. According to the embodiment illustrated, right end surface 162 and/or rear edge 164 define a lateral extremity of apron 140 and a rearward extremity of right end portion 160.

According to an exemplary embodiment, top flange 141 couples each of front face 142, left end surface 152, and right end surface 162 at generally rounded corners which provide a continuous surface transition. For example, top flange 141 is shown to couple front face 142 at top apron corner 144. Top apron corner 144 is shown to be continuously curved. Referring to FIGS. 3 and 4, the transition region between top flange 141 and front face 142 is generally convex. According to the various alternative embodiments, this transition region be angled and/or have discontinuously curved surface transitions from top flange 141 to front face 142. The rounded corners for each of corners top flange 141 to front face 142, top flange 141 to left end surface 152, and top flange 141 to right end surface 162 may have the same or different radii of curvature.

According to an exemplary embodiment, front face 142 couples each of left end surface 152 and right end surface 162 at generally rounded corners which provide a continuous surface transition. For example, front face 142 is shown to couple left end surface 152 at side apron corner 145. Side apron corner 145 is shown to be continuously curved. Referring to FIG. 2, the transition region between front face 142 and left end surface 152 is generally convex. According to the various alternative embodiments, this transition region may be angled and/or have discontinuously curved surface transitions from front face 142 to left end surface 152. The rounded corners for each of corners front face 142 to left end surface 152 and front face 142 to right end surface 162 may have the same or different radii of curvature.

As shown in FIGS. 1 and 2, apron 140 extends laterally beyond rim 130. Specifically, left end portion 150 extends leftward of left rim 132, while right end portion 160 extends rightward of right rim 133. In this manner, left end portion 150 and right end portion 160 extends laterally beyond the outer periphery defined by rim 130. According to an exemplary embodiment, apron 140 is also wider than basin 101.

In certain applications, having apron 140 extend beyond the width of basin rim 130 may allow a customer or installer to cut an opening in a cabinet face and to set the sink in the cabinet with little cabinet modification and/or without being concerned about making a precise cut in the cabinetry that would be visible to a user after the sink is installed. In such an application, left end surface 152 and right end surface 162 extend beyond the area in which cuts are made in the cabinetry to install sink 100. Thus, apron 140 overlaps the front face of the cabinet and may extend nearly the width of the cabinet. Traditional sinks having an equivalent apron width would require an installer to cut into the walls of the cabinet all the way to the ends of the apron. Furthermore, placing left end surface 152 and right end surface 162 farther outward facilitates aligning the lateral ends of the apron with the lateral edges of doors below the installed sink.

Referring to FIGS. 3 and 4, a backside of apron 140 defines a second plane, shown as rear apron plane 192, defined by rear edge 154 and rear edge 164. Rear apron plane 192 is shown as being substantially vertical. According to the embodiment illustrated, rear apron plane 192 is substantially perpendicular to rim plane 191 and substantially parallel to front face 142. Having a substantially vertical rear apron plane provides a substantially flat backside to the apron. Rear apron plane 192 may be configured to abut a front surface of a cabinet when sink 100 is in an installed position. As such, when sink 100 is installed, the apron may fit flush against the front of the cabinet instead of dropping into a cut or an opening. This may save the installer iterative cutting and fitting, which requires repeated lifting of the sink The height of apron 140 may vary depending on the application. For example, sink 100 may include a full apron, as shown in FIG. 3, which includes a taller front face 142' or may include a short apron, as shown in FIG. 4, which includes a shorter front face 142. According to the embodiment shown in FIG. 3, front face 142' extends downward from rim plane 191 between approximately 8 inches and 9 inches, while front face 142 of the embodiment shown in FIG. 4 extends downward from rim plane 191 between approximately 6 inches and 7 inches. The height of apron 140 may depend on a number of factors including the size of the opening from a false drawer front that the apron needs to conceal, the available space between the tops of the doors and the top of the cabinet, etc.

Apron 140 is also shown as including a third end portion, shown as bottom end portion 170. Bottom end portion 170 includes a third end surface, shown as bottom end surface 172. According to one embodiment, bottom end surface 172 extends generally rearwardly from front surface 142. Bottom end surface 172 has a rear edge 174 that is coplanar with rear apron plane 192. According to the embodiment shown, rear apron plane 192 is defined by rear edge 154, rear edge 164, and bottom edge 174.

According to an exemplary embodiment, bottom end surface 172 is coupled to each of front face 142, left end surface 152, and right end surface 162 at generally rounded corners which provide a continuous surface transition. According to the embodiment illustrated, this transition region is continuously curved and generally convex. According to the various alternative embodiments, this transition region may be angled and/or have discontinuously curved surface transitions from the bottom end surface to the adjacent surfaces. The rounded corners for each of corners bottom end surface 172 to front face 142, bottom end surface 172 to left end surface 152, and bottom end surface 172 to right end surface 162 may have the same or different radii of curvature. According to the exemplary embodiment shown, the radii of curvature for the corners adjacent to bottom end surface 172 are greater than the radii of curvature for the corners adjacent to top flange 141, for example, top apron corner 144.

A back side of apron 140 is shown as defining a cavity 180 (e.g., recess, depression, carve-out, hollow, etc. Cavity 180 may be formed by a variety of methods. According to an exemplary embodiment, sink 100 is formed of cast iron and cavity 180 is formed by placing an insert into the mold prior to casting sink 100. Cavity 180 may reduce the amount of material in sink 100, which may reduce the overall weight of sink 100. Cavity 180 may also reduce the weight of the apron cantilevered from basin 101 when sink 100 is in an installed position, thus reducing the load on top flange 141. Reducing the weight of the apron cantilevered from basin 101 facilitates positioning front face 142 farther forward. Positioning front face 142 farther forward enables positioning a top portion of front sidewall 121 farther forward, which facilitates access to the reservoir by a user. Positioning front face 142 farther forward may define a drip line from apron 140 farther forward than front surfaces of doors located below apron 140 when sink 100 is in an installed position. Cavity 180 removes material from a rear portion of apron 140, which allows rear apron plane 192 to be defined by edges 154, 164, and 174, thus facilitating tighter control of tolerances.

Figure 5:
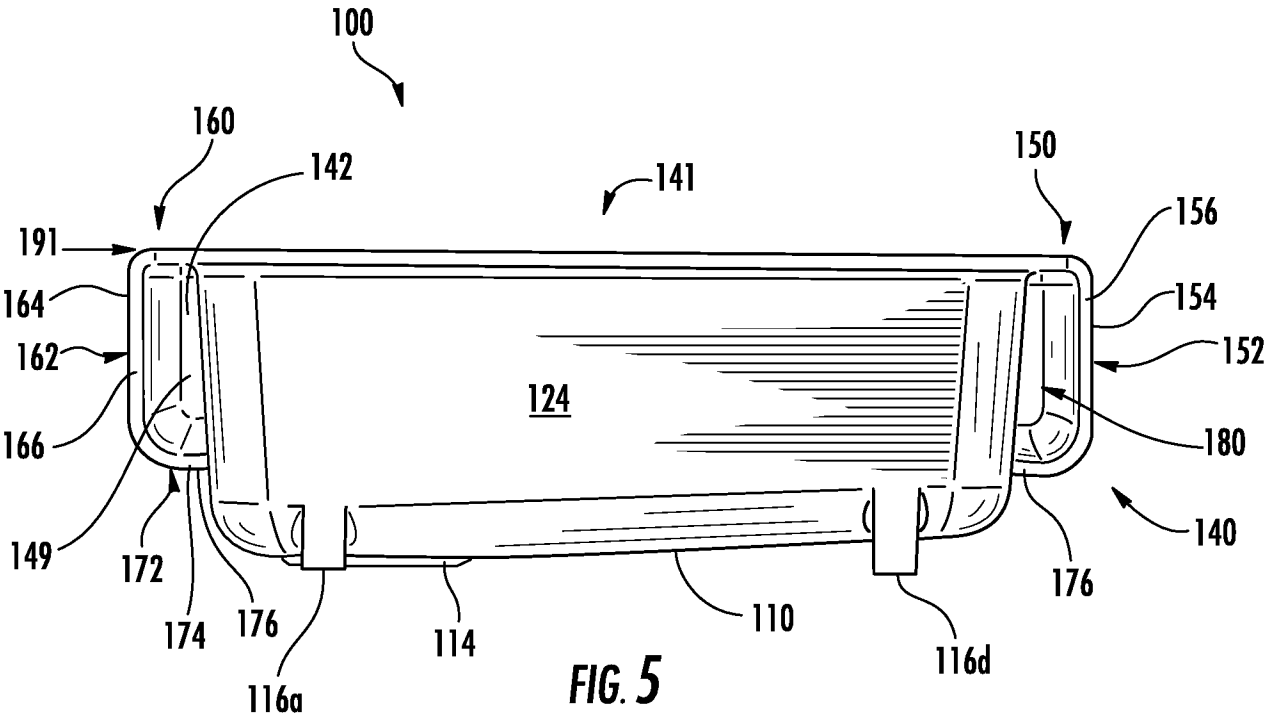
FIG. 5 is a rear planar view of the sink of FIG. 1, shown according to an exemplary embodiment.

Apron 140 has a rear surface 149 disposed on the reverse of front face 142. Rear surface 149 may at least partially define cavity 180. According to one embodiment, rear surface 149 is generally concave. According to the embodiment illustrated, the cross section of apron 140 is substantially C-shaped in a vertical direction, with the opening of the "C" facing rearwardly towards basin 101. Left end portion 150 and right end portion 160 are shown to have substantially a C-shape in a lateral direction with the open portions of the "C"s facing towards each other as shown in FIG. 5.

Referring back to FIGS. 2-4, and the configuration of the sidewalls 120 of basin 101, front sidewall 121 is shown as being provided at an angle relative to rim plane 191. According to an exemplary embodiment, front sidewall 121 is supported at an angle relative to rim plane 191 of between approximately 65 and 75 degrees. Preferably, front sidewall 121 is supported at an angle relative to rim plane 191 of between approximately 69 and 73 degrees. According to the embodiment illustrated, front sidewall 121 is supported at an angle relative to rim plane 191 of approximately 71 degrees. According to the various alternative embodiments, front sidewall 121 may be provided at any angle relative to the rim plane 191 that slants that front sidewall 121 towards the center of basin 101.

Considering a different reference point, front sidewall 121 is supported at an angle relative to rear apron plane 192 of between approximately 15 and 25 degrees. Preferably, front sidewall 121 is supported at an angle relative to rear apron plane 192 of between approximately 17 and 21 degrees. According to the embodiment illustrated, front sidewall 121 is supported at an angle relative to rear apron plane 192 of approximately 19 degrees. According to the various alternative embodiments, front sidewall 121 may be provided at any angle relative to the rear apron plane 2 that slants that front sidewall 121 towards the center of basin 101. According to the embodiment shown, a bottom portion of front sidewall 121 is rearward of rear apron plane 192, and a top portion of sidewall 121 is forward of rear apron plane 192.

Supporting front sidewall 121 at an angle may reduce a fore-aft dimension of top flange 141 while locating floor 110 within a cabinet and locating front face 142 forward of doors located below apron 140 when sink 100 is in an installed position. Positioning front face 142 farther forward of the doors may define a drip line from apron 140 farther forward than front surfaces of the doors, thus helping to keep fluid from flowing into the cabinet or staining the doors. Reducing the fore-aft dimension of top flange 141 may provide an aesthetic benefit, facilitate user access the reservoir, and reduce the weight cantilevered from basin 101. Supporting the front sidewall 121 at the above specified angles may allow front sidewall 121 to pass over the bottom edge of a drawer opening in the front face of the cabinet, thus reducing the amount of modification to the cabinet required prior to installing sink 100 into the cabinet. Supporting front sidewall 121 at an angle may also assist in directing fluid or other waste towards the drain.

As shown in FIGS. 3 and 4, bottom end portion 170, bottom end surface 172, and bottom edge 174 are offset or spaced apart from front sidewall 121. According to an exemplary embodiment, no supports (e.g. structures, members, spars, flanges, webs, etc.) extend between front sidewall 121 and apron 140 other than rim 130. Disconnecting the bottom of apron 140 from front sidewall 121 enables a portion the cabinet to fit between the apron and the basin. This enables apron 140 to be installed flush to a front face of the cabinet. Further this requires less precise cutting by an installer because the cut edges of the cabinet will be hidden from view.

Figure 6:
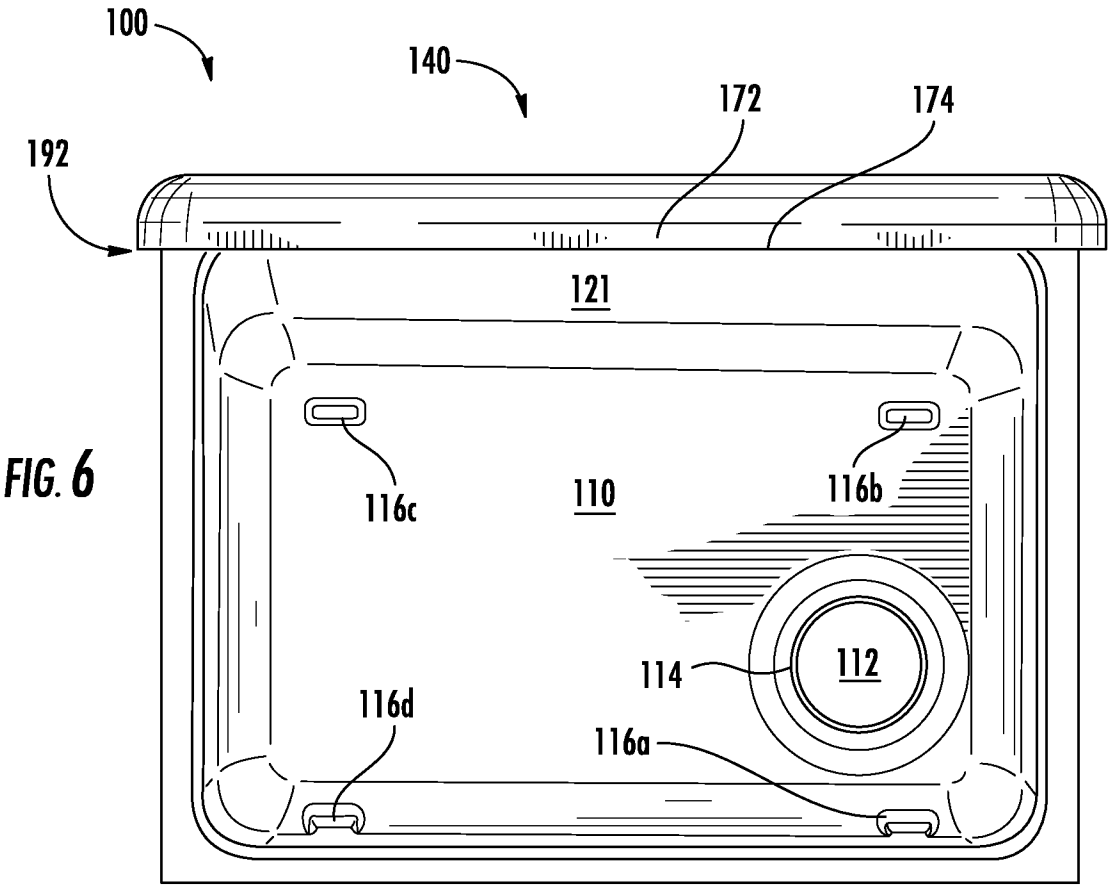
FIG. 6 is a bottom planar view of the sink of FIG. 1, shown according to an exemplary embodiment.

Sink 100 may also include one or more feet 116 or other structure to help stabilize and/or support the sink. According to the embodiment illustrated, sink 100 includes foot 116*a*, foot 116*b*, foot 116*c*, and foot 116*d*. Feet 116 are shown to extend downwardly from bottom surface 118 of floor 110. According to an exemplary embodiment, feet 116 are coupled to sink 100 by being an integrally formed part of sink 100. Referring to FIG. 6, foot 116*a* is shown disposed under a rear right portion of sink 100, foot 116*b* is shown disposed under front right portion of basin 101, foot 116*c* is shown located under front left portion of floor 110, foot 116*d* is shown located under rear right portion of bottom surface 118.

Feet 116 may be configured to provide support and stability for sink 100. Feet 116 may provide protection to bottom surface 118 and drain 112 during construction, during transit, and when sink 100 set down, for example, after sink 100 is removed from a shipping box and prior to installation. If sink 100 is installed in a cabinet which provides a shelf to support a sink, feet 116 may rest on said shelf and provide stable support for sink 100.

Sink 100 may be formed of any suitably rigid material. Basin 101 and apron 140 may be the same or different materials. Basin 101 and apron 140 may be one piece or may be constructed of several pieces coupled together (e.g., welded, stir-welded, soldered, sweated, joined, fastened, adhesively bonded, etc.). Basin 101 and apron 140 may be formed by any suitable means (e.g., stamping, casting, forging, bending, hammering, etc.). According to an exemplary embodiment, sink 100 is a single piece of cast iron. Forming the sink from cast iron may allow for the sink to have a tighter tolerance than a sink formed of fireclay. Tighter tolerances may facilitate configuring rear edge 154 and rear edge 164 to align with standard door widths, and configuring bottom edge 174 to align with standard door and/or drawer heights. Tighter tolerances may also enable an installer to cut a cabinet from measurements or a template, rather than iterative cutting and fitting of the sink to the cabinet. Tighter tolerances may further ensure that sink 100 will fit into a standard cabinet, as opposed to modifying a standard cabinet or ordering a custom cabinet often required with conventional apron-front sinks.

Figure 7:
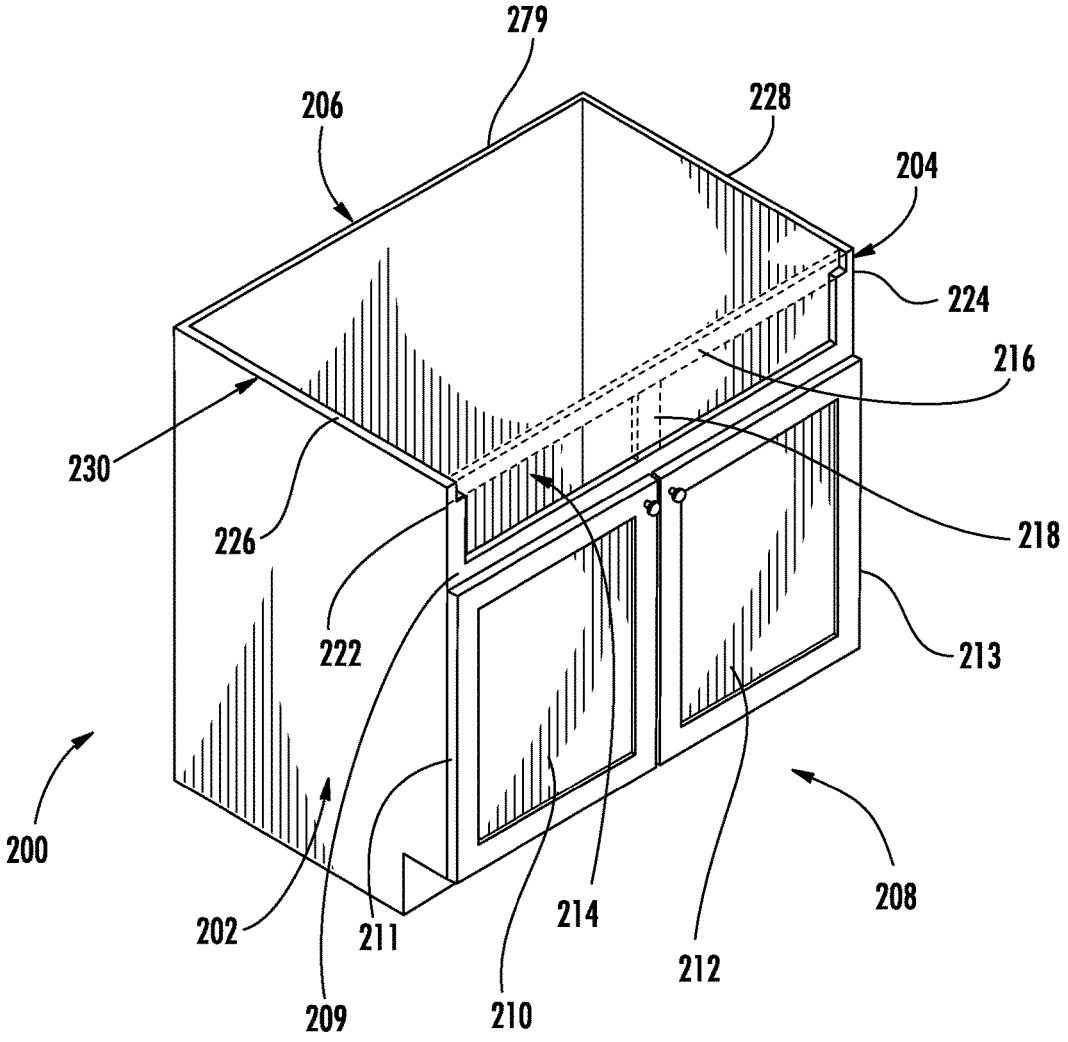
FIG. 7 is a perspective view of a cabinet, shown according to an exemplary embodiment.
Figure 8:
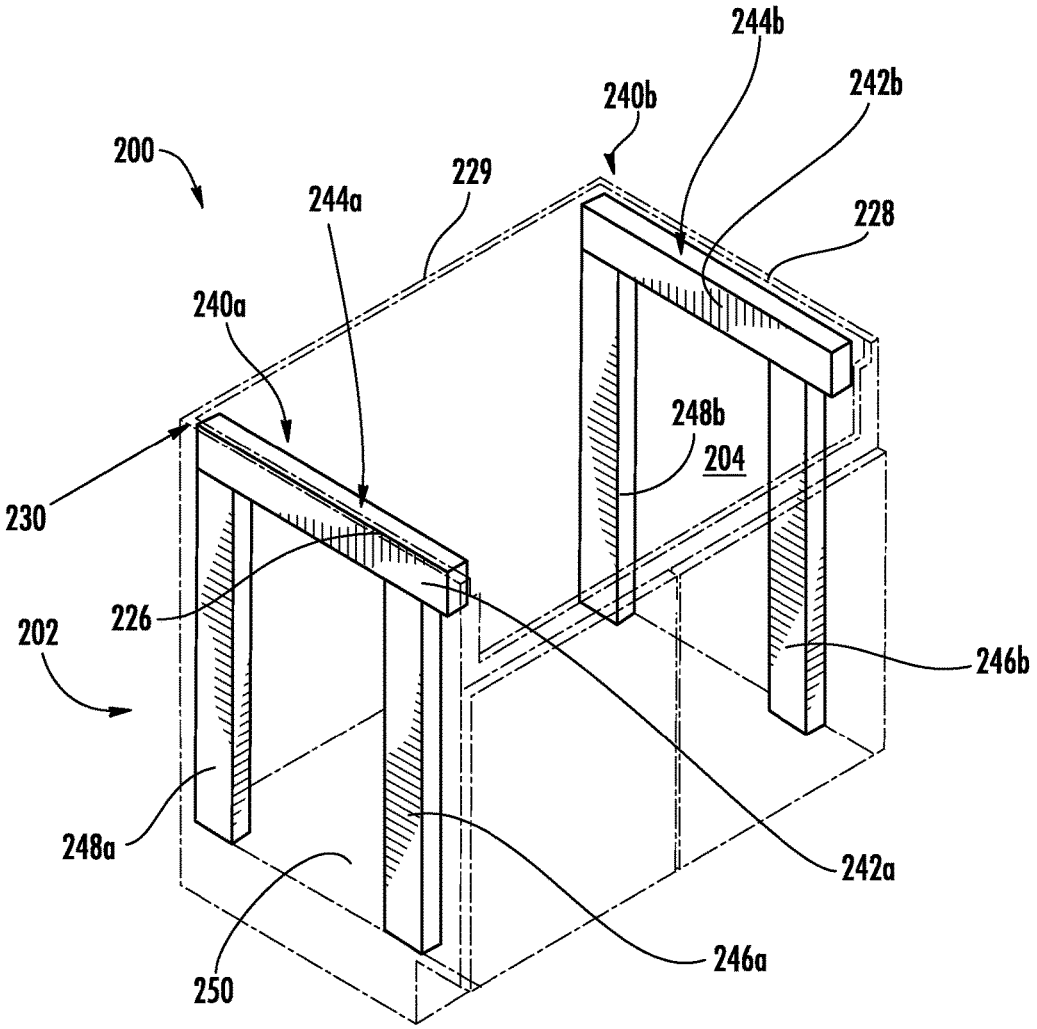
FIG. 8 is a perspective view of the cabinet of FIG. 7, shown according to an exemplary embodiment.
Figure 9:
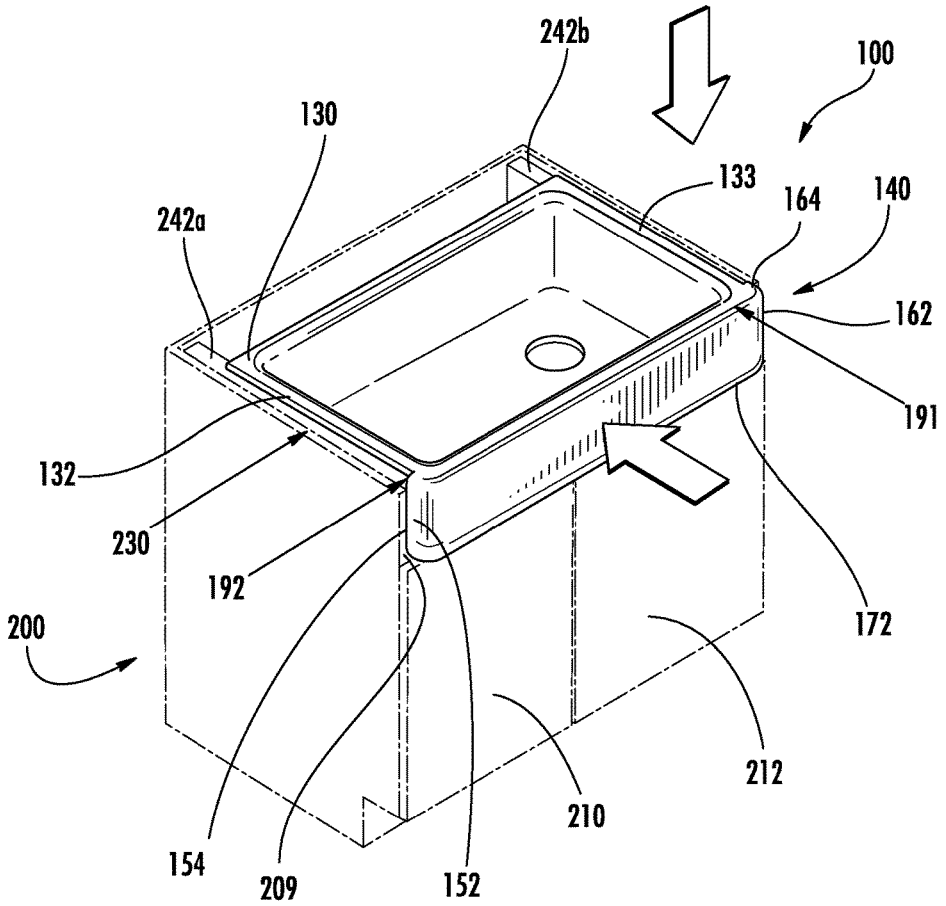
FIG. 9 is a perspective view of a sink installed in the cabinet of FIG. 7, shown according to an exemplary embodiment.

Referring to FIGS. 7-11, a method of installing sink 100 onto a support structure (e.g., stand, base cabinet, etc.), shown as cabinet 200, will be described according to an exemplary embodiment. FIGS. 7 and 9 generally refer to installation of a short apron embodiment of sink 100, while FIGS. 8, 10, and 11 generally refer to installation of a full apron embodiment of sink 100. Cabinet 200 may be any stock, standard, or custom cabinet. Cabinet 200 may include one or more walls, shown as left panel 202 and generally opposite right panel 204. Left panel 202 may have a left outside edge 222 and a left top edge 226. Right panel 204 may have a right outside edge 224 and right top edge 228. Cabinet 200 may include a rear panel 206 adjacent to both left panel 202 and right panel 204. Rear panel 206 may include a rear top edge 229. Panels 202, 204, and 206 are shown to be substantially vertical. Left top edge 226, right top edge 228, and rear top edge 229 may substantially define a plane, shown as plane 230. Panels 202, 204, and 206 may or may not be standard height. As shown, panels 202, 204, and 206 are approximately 34.5 inches tall. Panels 202 and 204 may or may not be standard distance apart. According to one exemplary embodiment, panels 202 and 204 are approximately 36 inches apart. According to another exemplary embodiment, panels 202 and 204 are approximately 33 inches apart. According to the embodiment illustrated, panels 202 and 204 are approximately 30 inches apart.

Referring to FIG. 7 in particular, cabinet 200 may have front panel 208. Front panel 208 may include front surface 209. According to one exemplary embodiment, cabinet 200 includes at least one door movably disposed on a lower portion of front panel 208. As shown, cabinet 200 includes first door, shown as left door 210, and a second door, shown as right door 212. Left door 210 includes a first edge shown as left vertical edge 211. Right door 212 includes a second edge, shown as right vertical edge 213. Front panel 208 may define an aperture, shown as drawer opening 214, above doors 210 and 212. According to one embodiment, drawer opening 214 is configured to receive one or more drawers which slidably couple to cabinet 200. According to another exemplary embodiment, cabinet 200 includes one or more false drawer panels which cover drawer opening 214. Front panel 208 may include a top rail, shown as rail 216, extending across a top front portion of cabinet 200 and at least partially defining aperture 214. Front panel 208 may include a support member, shown as center support 218, which extends vertically through drawer opening 214 and supports rail 216. As described, cabinet 200 may not be configured to receive a traditional apron-front sink.

If cabinet 200 is already supporting a sink, the existing sink will first need to be removed from cabinet 200. If cabinet 200 includes one or more drawers received in drawer opening 214, or if cabinet 200 includes one or more false drawer panels, the drawers and/or the false drawer panels should be removed from cabinet 200. If cabinet 200 includes rail 216, rail 216 will need to be removed from cabinet 200. According to one exemplary embodiment, the step of removing rail 216 may include one or more of the following: measuring a first distance of approximately ⅞ inch inward from left outside edge 222; marking the first distance on front panel 208, for example, on front surface 209; measuring a second distance of approximately ⅞ inward from left outside edge 222; marking the second distance on front panel 208; making a first substantially vertical cut in front panel 208 approximately ⅞ inch inward from left outside edge 222; and making a second substantially vertical cut approximately ⅞ inch inward from right outside edge 224. According to an exemplary embodiment, the first substantially vertical cut and the second substantially vertical cut should extend below the top of drawer opening 214 and below the bottom of rail 216. Additional steps may include: making a first substantially horizontal cut parallel to a bottom surface of rail 216 until the first substantially horizontal cut intersects the first substantially vertical cut; and making a second substantially horizontal cut parallel to a bottom surface of rail 216 until the second substantially horizontal cut intersects the second substantially vertical cut. According to an exemplary embodiment, the first substantially horizontal cut and the second substantially horizontal cut may be substantially even with a top of drawer opening 214. According to another exemplary embodiment, the first substantially horizontal cut may be made into an inside left portion of front panel 208, and the second substantially horizontal cut may be made into an inside right portion of front panel 208. If cabinet 200 includes center support 218, a third substantially horizontal cut may be made through center support 218. As shown, the third substantially horizontally cut is substantially even with the bottom of drawer opening 214. After completion of these steps, rail 216 and/or center support 218 may be removed.

Referring to FIG. 8, one or more supports (e.g., members, structures, framing, support framing, etc.), referred to as a support 240, may be added to support sink 100. According to the embodiment illustrated, support 240 includes a first support, shown as left support 240*a*, and a second support, shown as right support 240*b*. Support 240 may include one or more top supports, shown as top left support 242*a* and top right support 242*b*. Top left support 242*a* and top right support 242*b* are configured to extend along the inside walls of the left and right sides of cabinet 200, respectively. The top supports may include top surfaces, shown as left top surface 244*a* and right top surface 244*b*. Support 240 may include one or more vertical supports, shown as front left support 246*a*, rear left support 248*a*, front right support 246*b*, and rear right support 248*b*. Support 240 may be made from any suitable material (e.g., wood, metal, plastic, composites, etc.).

According to one exemplary embodiment, support 240 may be installed into cabinet 200 by one or more of the following steps: coupling top left support 242*a* to an inside wall of left panel 202 such that a top surface 244*a* is level (e.g., substantially horizontal) and approximately 0.5 inch below left top edge 226 and plane 230; cutting one or more vertical supports to a length substantially equal to the distance from a bottom of installed top left support 242*a* to floor 250 of cabinet 200; coupling front left support 246*a* and rear left support 248*a* to an inside wall of left panel 202 between a bottom surface of top left support 242*a* and floor 250. According to an exemplary embodiment, support 240 may be screwed to cabinet 200. Screws may be selected such that the screws are long enough to secure support 240 to left panel 202 but short enough not to extend through the inner walls of adjacent cabinets. One of skill in the art will understand from this disclosure that the steps and configurations above may be repeated for additional sides of cabinet 200, for example, secure support 240*b* to right panel 204.

With support 240 in place, sink 100 can now be installed into cabinet 200. Referring to FIG. 9, installing sink 100 may include placing sink 100 onto top support 242 by lowering sink 100 onto top support 242 and until rim 130 is supported by top support 242, for example, by having left rim 132 supported by top left support 242*a* and right rim 133 supported by top right support 242*b*. With rim 130 supported by top support 242, sink 100 may be slid in a rearward direction along top support 242 to an installed position. According to an exemplary embodiment, in an installed position, rear edge 154, rear edge 164, and/or bottom edge 174 are substantially flush with a front surface 209 of cabinet 200. According to another exemplary embodiment, in an installed position, rear apron plane 192 is substantially flush with a front surface 209 of cabinet 200. If necessary, shims may be inserted between support 240 and rim 130 such that the top of sink 100 is flush with the top of cabinet 200. With sink 100 in the installed position, a sealant (e.g., a silicone sealant) may be applied along a top surface of rim 130. After sink 100 is installed, a countertop may be installed onto cabinet 200 that at least partially covers rim 130.

According to an exemplary embodiment, apron 140 of sink 100 extends beyond drawer opening 214. According to the embodiment illustrated, the lateral distance from left end surface 152 to right end surface 162 is greater than a lateral width of drawer opening 214. Also, bottom end surface 172 is shown as being below a bottom of drawer opening 214. The short apron configuration of sink 100 may enable the use of taller doors 210 and 212, the option of installing non-apron-front height doors onto cabinet 200, and/or the option of installing standard height doors under sink 100. According to one exemplary embodiment, bottom end surface 172 of sink 100 is configured to substantially align with bottom edges of adjacent drawers. According to another exemplary embodiment, the short apron configuration of sink 100 enables doors 210 and 212 to be the same height as adjacent doors. Enabling full height doors facilitates retrofitting sink 100 into pre-existing cabinetry.

Figure 10:
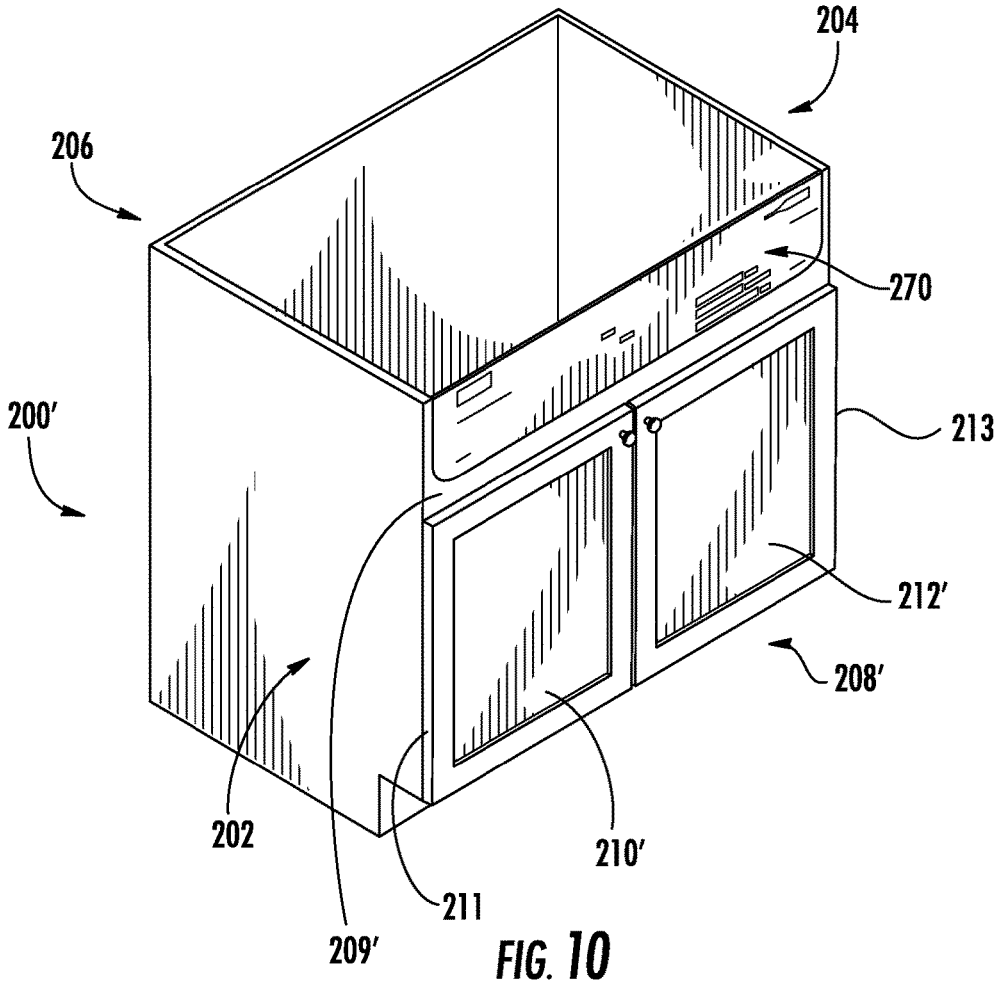
FIG. 10 is a perspective view of an cabinet, shown according to another embodiment.

Referring to FIG. 10, cabinet 200' may have front panel 208'. Front panel 208' may include front surface 209'. According to one embodiment, cabinet 200' includes at least one door movably disposed on a lower portion of front panel 208'. As shown, cabinet 200' includes first door, shown as left door 210', and a second door, shown as right door 212'. Left door 210' includes a first edge shown as left vertical edge 211. Right door 212' includes a second edge, shown as right vertical edge 213. As shown, front panel 208' does not include drawer opening 214 above doors 210' and 212'. As described, cabinet 200' may be configured to receive a traditional apron-front sink.

The method of installing sink 100 into cabinet 200' may initially include providing a template 270. Template 270 may be provided on any suitable material. According to one exemplary embodiment template 270 is made from a rigid or semi-rigid material, for example, plastic or metal. According to another exemplary embodiment, template 270 is printed on a paper-based material (e.g., cardboard, corrugated paper, etc.). According to the embodiment illustrated, template 270 is printed on paper. With template 270 provided, one or more of the followings steps may be completed: cutting template 270 from surrounding paper; positioning template 270 on front surface 209' flush with a top edge of front panel 208' and centered on front panel 208'; securing template 270 to front surface 209'; tracing template 270 onto front surface 209'; removing template 270 from front surface 209'; and cutting cabinet 200' substantially along the traced line. According to another exemplary embodiment, template 270 can be secured to front surface 209' and cabinet 200' can be cut substantially along a perimeter of template 270. According to yet another exemplary embodiment, template 270 may be printed onto front panel 208', in which case, cabinet 200' can be cut substantially along a perimeter of template 270. The area defined by template 270 on front surface 209' may be configured to be within an area covered by apron 140 when sink 100 is in an installed position. As such, the installer need not be precise while cutting front panel 208' as the cuts will be hidden from view by apron 140.

Figure 11:
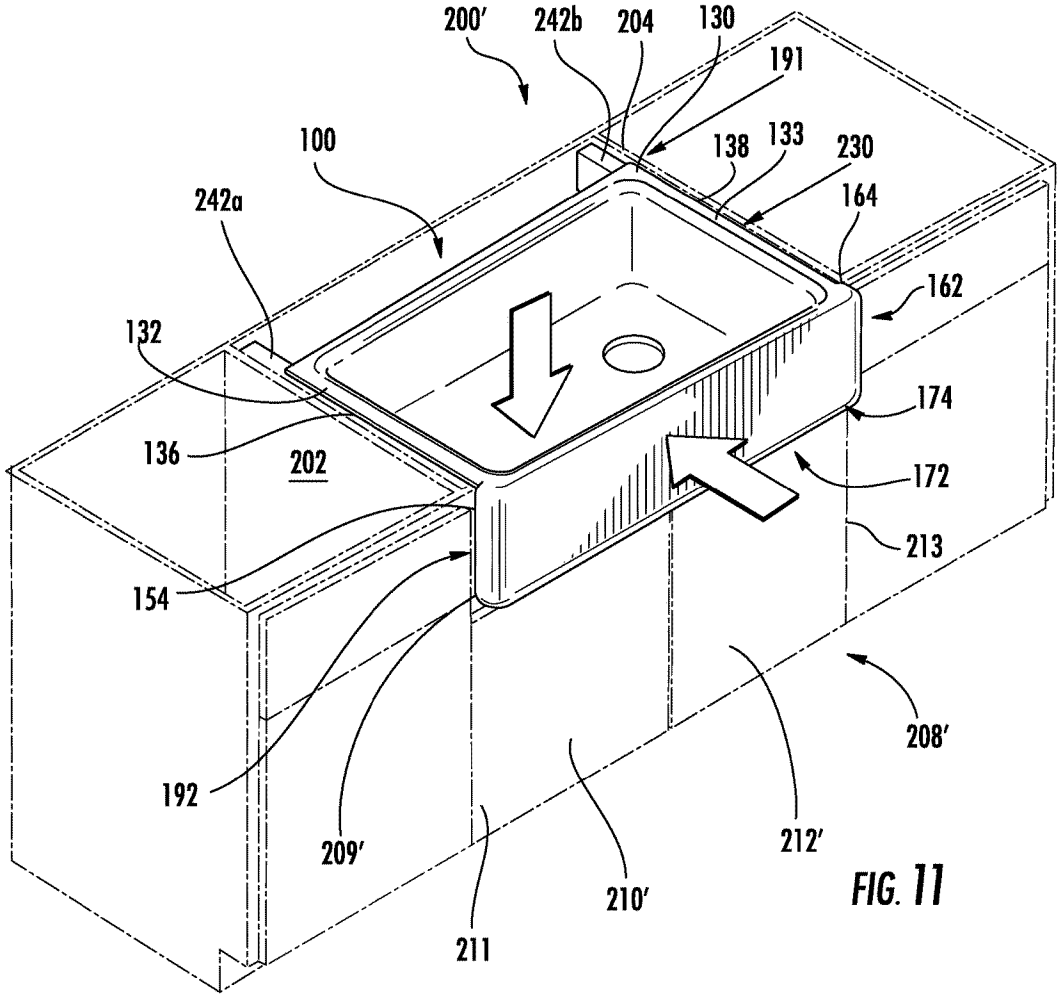
FIG. 11 is a perspective view of a sink installed in the cabinet of FIG. 10, shown according to an exemplary embodiment.
Figure 12:
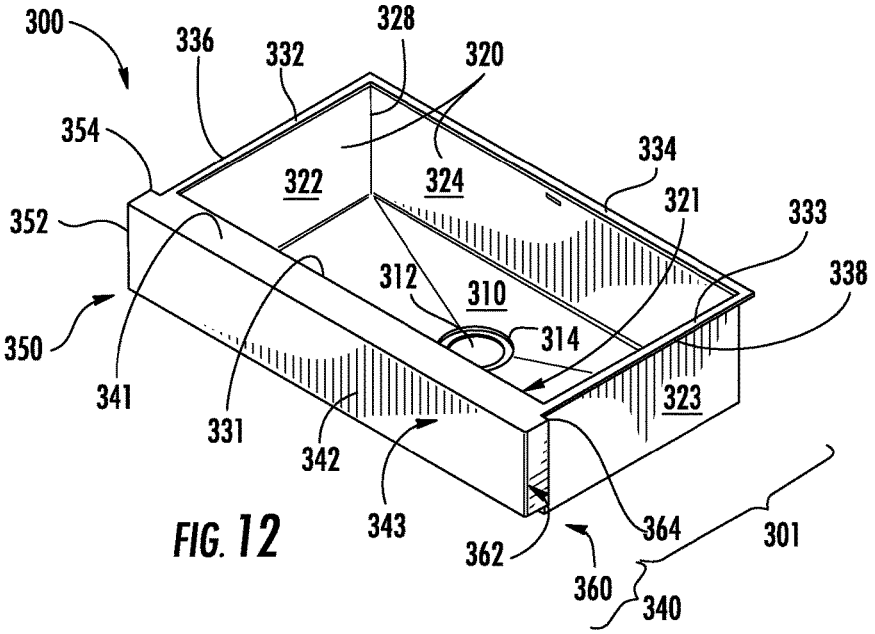
FIG. 12 is a perspective view of a sink, shown according to a second exemplary embodiment.

Referring to FIG. 11, the method of installing sink 100 into cabinet 200' also includes the step of placing sink 100 onto top support 242 by lowering sink 100 onto top support 242. According to one exemplary embodiment, rim 130 is supported by top support 242, such as by having left rim 132 supported by top left support 242*a* and right rim 133 supported by top right support 242*b*. If necessary, sink 100 can be pushed back in rearward direction along top support 242 to an installed position. According to one exemplary embodiment, in an installed position, rear edge 154, rear edge 164, and/or bottom edge 174 are substantially flush with a front surface 209' of cabinet 200' and rear apron plane 192 is substantially flush with a front surface 209' of cabinet 200'. If necessary, shims may be inserted between support 240 and rim 130 so that the top of sink 100 is flush with the top of cabinet 200'.

Once in position, rim 130 may be dried and cleaned so that a sealant (e.g., a silicone sealant) can be applied along a top surface of rim 130. Countertop can then be installed onto cabinet 200'. Shims may be used so that plane 230 of cabinet 200' is flush with rim plane 191 of sink 100. According to one exemplary embodiment, apron 140 of sink 100 extends beyond the cut made into front panel 208'. According to the embodiment illustrated, the lateral distance from left end surface 152 to right end surface 162 is greater than a lateral width of the cut made into front panel 208'. As shown, bottom end surface 172 is below a bottom of the cut made into front panel 208'.

Installation of a full apron sink requires shorter doors than does a short apron sink. As shown, top edges of doors 210' and 212' are lower than top edges of doors 210 and 212, shown in FIG. 9. As shown, top edges of doors 210' and 212' are lower than top edges of adjacent doors. According to the embodiment shown in FIGS. 9 and 11, left end surface 152 and right end surface 162 of sink 100 are configured to substantially align with left vertical edge 211 and right vertical edge 213, respectively. Further the distance from left rim edge 136 to right rim edge 138 is configured to be less than the distance from left panel 202 to right panel 204. As such, modification of panels 202 and 204 is not required. While rim 130 is described as configured to be installed below a countertop, it is contemplated that rim 130 may be installed above a countertop.

Referring to FIGS. 12-16, a sink 300 is shown according to another exemplary embodiment. For convenience, components of sink 300 that are similar to the components of sink 100 are similarly numbered (e.g., front sidewall 121, 321, etc.). Sink 300 includes a receptacle for receiving and/or holding water (e.g., reservoir, washbasin, bowl, etc.), shown as basin 301. Basin 301 may have a variety of shapes, for example, circular, oval, polygonal, or sections of the shapes thereof (e.g. circle sector). According to the embodiment shown, basin 301 is substantially rectangular with a lateral width dimension being greater than the depth dimension.

Basin 301 is shown as including a floor 310. Floor 310 may have a variety of shapes and textures. As shown, floor 310 includes one or more sections which are each substantially planar. According to the various alternative embodiments, the sections of floor 310 may be non-planar, or the sidewalls of basin 301 may be continuously curved such that no discernable floor is formed. Floor 310 defines one or more apertures, shown as drain hole 312, that allow water to be removed from basin 301. Floor 310 may include a lip, shown as drain 314, which substantially defines drain hole 312. According to the embodiment shown, drain 314 encircles drain hole 312. Drain 314 may be coupled to a drain pipe and/or a garbage disposal mechanism, which is in turn coupled to a municipal sewerage system or to a septic system. Floor 310 is shown as being sloped towards drain 314. For example, segments for floor 310 are each sloped towards drain 314 such that water in basin 301 may flow towards drain 314 by gravitational force.

Basin 301 is also shown as including one or more sidewalls (generically referred to as sidewall 320) which extend generally upwardly from floor 310. According to the embodiment illustrated, basin 301 includes a first through fourth sidewalls, shown as front sidewall 321 (e.g., the sidewall of the front portion), a left sidewall 322, a right sidewall 323, and a rear sidewall 324. Front sidewall 321 extends laterally across a front portion of basin 301, rear sidewall 324 extends laterally across a rear portion of basin 301, left sidewall 322 extends front-to-back between front sidewall 321 and rear sidewall 324 along a first side portion of basin 301 (i.e., a left side portion) and right sidewall 323 extends front-to-back between front sidewall 321 and rear sidewall 324 along a second side portion of basin 301 (i.e., a right side portion). According to the embodiment shown, sidewalls 320 are substantially vertical.

According to an exemplary embodiment, sidewalls 320 are coupled to floor 310 at substantially angled corners. According to an exemplary embodiment, the angle between sidewalls 320 and segments of floor 310 is between approximately 94 degrees and 99 degrees. According to the various alternative embodiments, the corners may be continuously curved or have discontinuously curved surface transitions from floor 310 to sidewall 320. Each of corners floor 310 to front sidewall 321, floor 310 to left sidewall 322, floor 310 to right sidewall 323, and floor 310 to rear sidewall 324 may have the same or different angle.

According to an exemplary embodiment, sidewalls 320 are coupled to each other at substantially right angles. According to the various alternative embodiments, the corners may be continuously curved or have discontinuously curved surface transitions from sidewall 320 to adjacent to sidewall 320. The angles for each of corners front sidewall 321 to left sidewall 322, left sidewall 322 to rear sidewall 324, rear sidewall 324 to right sidewall 323, and right sidewall 323 to front sidewall 321 may be the same or different.

Basin 301 is further shown as including one or more flanges or rims (generically referred to as rim 330) that at least partially define an outer and/or upper periphery of basin 301. Rim 330 is shown as being provided at a top portion of sidewall 320 and extending generally outwardly therefrom. According to an exemplary embodiment, basin 301 includes a front rim 331, a left rim 332, a right rim 333, and a rear rim 334. Front rim 331 extends from a top portion of front sidewall 321, left rim 332 extends from a top portion of left sidewall 322, right rim 333 extends from a top portion of right sidewall 323, and rear rim 334 extends from a top portion of rear sidewall 324. The thickness of rim 330 may be the same or different than the thickness of sidewall 320. Further, the individual thicknesses of each of front rim 331, left rim 332, right rim 333, and rear rim 334 may be the same or different. According to the embodiment illustrated, front rim 331, left rim 332, right rim 333, and rear rim 334 have substantially the same thickness. According to the embodiment illustrated, left rim 332, right rim 333, and rear rim 334 have a substantially similar width. According to the various alternative embodiments, the width dimension may be the same or different for each of front rim 331, left rim 332, right rim 333, and/or rear rim 334. Front rim 331, left rim 332, right rim 333, and rear rim 334 are shown to form a continuous rim surface. According to the various alternative embodiments, rim 330 may be formed of discontinuous rim segments.

According to an exemplary embodiment, sink 300 is configured to be supported by rim 330. For example, sink 300 may be supported by an underside surface of rim 330, such as by having rim 330 rest on top of a countertop or any other suitable support surface. According to an exemplary embodiment, sink 300 is configured to be supported by having a bottom portion of rim 330 directly engage the support structure. According to another exemplary embodiment, rim 330 may be supported against a bottom surface of a countertop. According to yet another exemplary embodiment, sink 300 may be at least partially supported by a top portion of rim 330. For example, a top surface of rim 330 may be coupled (e.g., adhesively bonded, etc.) to a bottom surface of a countertop.

According to an exemplary embodiment, each rim 330 is coupled to each adjacent sidewall 320 at substantially right angles. According to the various alternative embodiments, the corners may be continuously curved or provide discontinuously curved surface transitions from rim 330 to adjacent to sidewall 320. Each of corners front rim 331 to front sidewall 321, left rim 332 to left sidewall 322, right rim 333 to right sidewall 323, and rear rim 334 to rear sidewall 324 may have the same or different angles.

Figure 14:
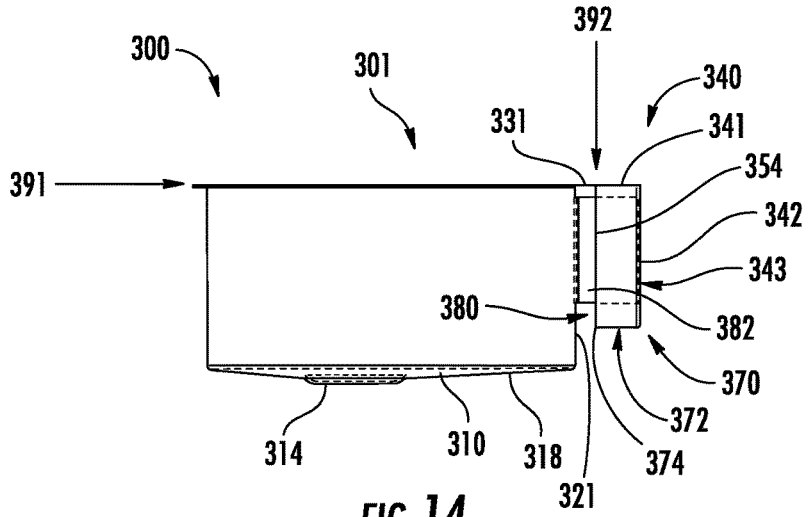
FIG. 14 is a side planar view of the sink of FIG. 12, shown according to an exemplary embodiment.

Referring to FIG. 14, rim 330 defines a first plane (e.g., top plane), shown as rim plane 391. According to the embodiment illustrated, front rim 331, left rim 332, right rim 333 and/or rear rim 334 cooperate to define rim plane 391. According to an exemplary embodiment, rim plane 391 is a substantially horizontal plane.

Referring back to FIG. 12, left rim 332 has a first edge, shown as left rim edge 336, and right rim 333 has a second edge, shown as right rim edge 338. Left rim edge 336 and/or right rim edge 338 may at least partially define a periphery of basin 301. According to an exemplary embodiment, the distance from left rim edge 336 to right rim edge 338 is approximately 34 inches, and the distance from left sidewall 322 to right sidewall 323 is approximately 32.5 inches. According to another exemplary embodiment, left rim edge 336 and right rim edge 338 are approximately 31 inches apart for a reservoir that has a width of approximately 29.5 inches. According to the embodiment illustrated, left rim edge 336 and right rim edge 338 are approximately 28 inches apart for a reservoir that has a width of approximately 26.5 inches. According to the various exemplary embodiments, the rim may be sized to be greater or less than the dimensions provided above.

Sink 300 also includes an apron 340 that extends laterally across a front portion of sink 300 to define a front portion of the sink that is configured to be visible to a user when installed. As shown, apron 340 is coupled to basin 301 and is supported at a substantially vertical orientation. According to an exemplary embodiment, apron 340 includes a first surface (e.g., structure, member, etc.), shown as top flange 341, a second surface (e.g., structure, member, etc.) shown as front face 342, a first end surface, shown as left end portion 350, and a second end surface, shown as right end portion 360. Left end portion 350 is shown as being located laterally opposite of right end portion 360.

Top flange 341 extends outwardly in a forward direction from a top portion of front sidewall 321 and front rim 331. According to various embodiments, a top surface of apron 340 may be substantially defined by top flange 341, front rim 331, or any combination thereof. According to the embodiment illustrated, the transition from top flange 341 to front rim 331 is substantially continuous. Similarly, the transition from top flange 341 to left rim 332, and the transition from top flange 341 to right rim 333, is also substantially continuous. According to an exemplary embodiment, front face 342 extends generally downwardly from top flange 341 in a vertical direction.

Top flange 341 is shown to extend laterally to left end portion 350 and to right end portion 360. Left end portion 350 and right end portion 360 form extension or wing portions that are configured to at least partially overlap or cover a portion of the cabinetry or other structure upon which the sink is supported. Left end portion 350 includes an end surface, shown as left end surface 352 that extends generally rearwardly. Left end surface 352 has a rear edge 354 that is configured to abut or be positioned adjacent a front face of the cabinetry supporting sink 300. According to the embodiment illustrated, left end surface 352 and/or rear edge 354 define a lateral extremity of apron 340 and a rearward extremity of left end portion 350. Similarly, right end portion 360 includes an end surface, shown as a right end surface 362, that extends generally rearwardly. Right end surface 362 has a rear edge 364 that is configured to abut or be positioned adjacent a front face of the cabinetry supporting sink 300. According to the embodiment illustrated, right end surface 362 and/or rear edge 364 define a lateral extremity of apron 340 and a rearward extremity of right end portion 360.

According to an exemplary embodiment, top flange 341 couples each of front face 342, left end surface 352, and right end surface 362 at substantially right angles. According to the various alternative embodiments, the corners may be continuously curved or provide discontinuously curved surface transitions. The angles for each of corners top flange 341 to front face 342, top flange 341 to left end surface 352, and top flange 341 to right end surface 362 may be the same or different angles.

According to the exemplary embodiment, front face 342 couples each of left end surface 352 and right end surface 362 at substantially right angles. According to alternative embodiments, the corners may be continuously curved or provide discontinuously curved surface transitions. The angles for each of corners front face 342 to left end surface 352 and front face 342 to right end surface 362 may be the same or different angles.

Figure 13:
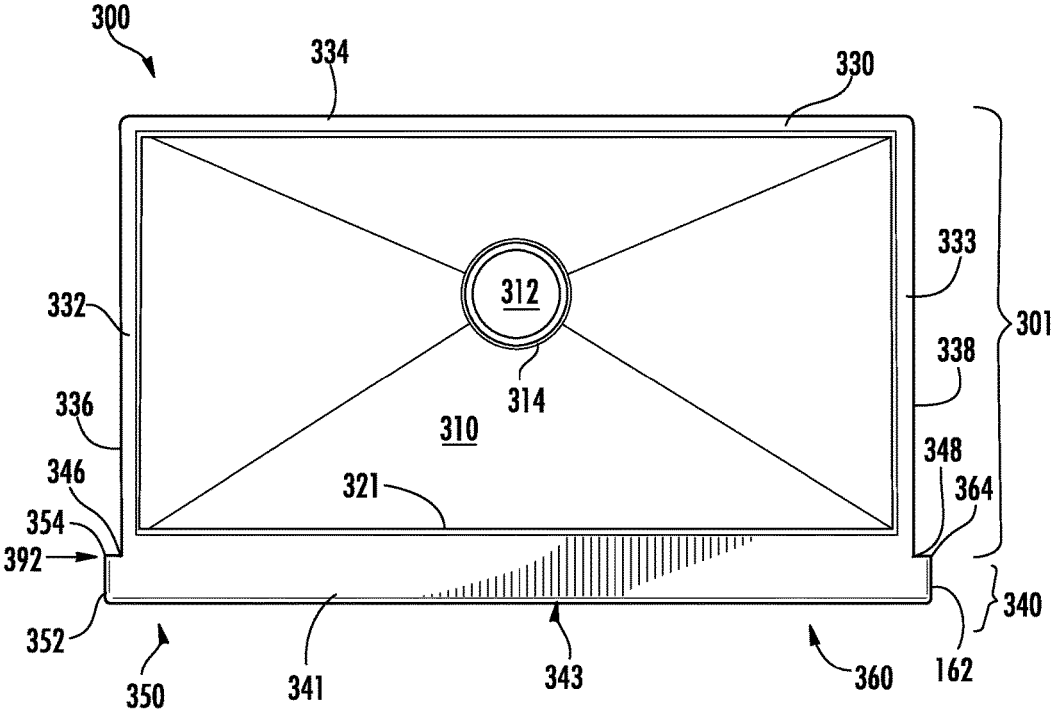
FIG. 13 is a top planar view of the sink of FIG. 12, shown according to an exemplary embodiment.

Referring to FIG. 13, a top view of sink 300 is shown according to an exemplary embodiment. As shown, apron 340 extends laterally beyond rim 330. Specifically, left end portion 350 extends leftward of left rim 332, while right end portion 360 extends rightward of right rim 333. In this manner, left end portion 350 and right end portion 360 extend laterally beyond the outer periphery defined by rim 330. According to an exemplary embodiment, apron 340 is also wider than basin 301.

In certain applications, having apron 340 extend beyond the width of basin rim 330 may allow a customer or installer to cut an opening in a cabinet face and to set the sink in the cabinet with little cabinet modification and/or without being concerned about making a precise cut in the cabinetry that would be visible to a user after the sink is installed. In such an application, left end surface 352 and right end surface 362 extend beyond the area in which cuts are made in the cabinetry to install sink 300. Thus, apron 340 overlaps the front face of the cabinet and may extend nearly the width of the cabinet. Traditional sinks having an equivalent apron width would require an installer to cut into the walls of the cabinet all the way to the ends of the apron. Furthermore, placing left end surface 352 and right end surface 362 farther outward facilitates aligning the lateral ends of the apron with the lateral edges of doors below the installed sink.

Referring to FIG. 14, a backside of apron 340 defines a second plane, shown as rear apron plane 392, defined by rear edge 354 and rear edge 364. Rear apron plane 392 is shown as being substantially vertical. According to the embodiment illustrated, rear apron plane 392 is substantially perpendicular to rim plane 391 and substantially parallel to front face 342 and front side wall 321. Rear apron plane 392 may be configured to abut a front surface of a cabinet when sink 300 is in an installed position. Rear apron plane 392 may be configured to be substantially flush to a front surface of a cabinet when sink 300 is in an installed position. Having a substantially vertical rear apron plane provides a substantially flat backside to the apron. As such, when sink 300 is installed, the apron may fit flush against the front of the cabinet instead of dropping into a cut or an opening. This may save the installer iterative cutting and fitting, which requires repeated lifting of the sink.

The height of apron 340 may vary depending on the application. For example, sink 300 may include a full apron or a short apron. According to the embodiment illustrated, apron 340 is a relatively short apron having a height between approximately 6 and 7 inches. The height is being defined as the distance from top flange 341 to bottom end surface 372 on apron 340. According to the various alternative embodiments, sink 300 may include a full apron, which descends between 8 inches and 9 inches from rim plane 391.

Apron 340 is also shown as including a third end portion, shown as bottom end portion 370. Bottom end portion 370 includes a third end surface, shown as a bottom end surface 372. Bottom end surface 372 extends generally rearwardly from front surface 342. Bottom end portion 372 has a rear edge 374 that is coplanar with rear apron plane 392. According to the embodiment shown, rear apron plane 392 is defined by rear edge 354, rear edge 364, and bottom edge 374.

According to an exemplary embodiment, bottom end surface 372 couples each of front face 342, left end surface 352, and right end surface 362 at substantially right angles. According to the various alternative embodiments, the corners may be continuously curved or have discontinuously curved surface transitions from the bottom end surface to the adjacent surfaces. Each of corners bottom end surface 372 to front face 342, bottom end surface 372 to left end surface 352, and bottom end surface 372 to right end surface 362 may be the same or different angles.

A backside of apron 340 is shown as defining a cavity 380. According to an exemplary embodiment, cavity 380 is defined by top flange 341, front face 342, left end portion 350, right end portion 360 and bottom end portion 370. Cavity 380 may be formed by a variety of methods. According to an exemplary embodiment, basin 301 and apron 340 are formed of stainless steel and cavity 380 is formed by bending or otherwise shaping the sheets of steel. Cavity 380 may reduce the amount of material in sink 300, which may reduce the overall weight of sink 300. Cavity 380 may also reduce the weight of the apron cantilevered from basin 301 when sink 300 is in an installed position, thus reducing the load on top flange 341. Reducing the weight of the apron cantilevered from basin 301 facilitates positioning front face 342 farther forward. Positioning front face 342 farther forward enables positioning a top portion of front sidewall 321 farther forward, which facilitates access to the basin by a user. Positioning front face 342 farther forward may define a drip line from apron 340 farther forward than front surfaces of doors located below apron 340 when sink 300 is in an installed position. Cavity 380 removes material from a rear portion of apron 340, which allows rear apron plane 392 to be defined by edges 354, 364, and 374, thus facilitating control of tolerances of rear apron plane 392.

Figure 15:
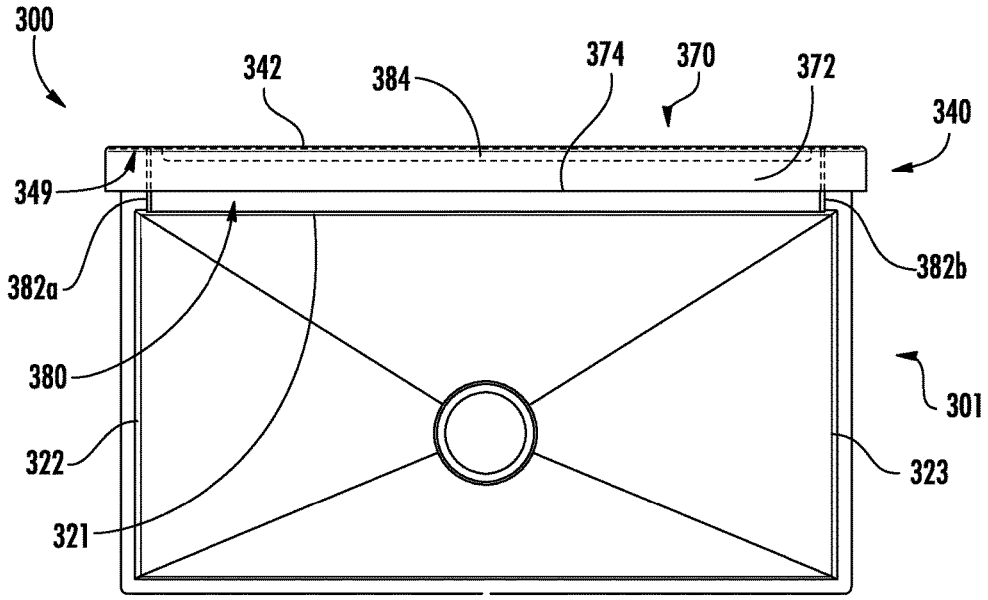
FIG. 15 is a bottom planar view of the sink of FIG. 12, shown according to an exemplary embodiment.

Referring to FIG. 15, apron 340 has a rear surface 349 disposed on the reverse of front face 342. Rear surface 349 may at least partially define cavity 380. According to the embodiment illustrated, the cross section of apron 340 is substantially C-shaped in a vertical direction, with the opening of the "C" facing rearwardly towards basin 301. Apron 340 is also substantially C-shaped in a horizontal direction, with the opening of the "C" facing rearwardly towards basin 301. Left end portion 350 and right end portion 360 each have a substantially C-shaped in a lateral direction with the open portions of the "C"s facing towards each other.

Apron 340 may include a structure (e.g., member, reinforcement, etc.), shown as beam 384. Beam 384 is shown disposed to extend laterally across rear surface 349. Beam 384 may be coupled to rear surface 349 in a variety of methods. According to an exemplary embodiment, beam 384 is coupled to rear surface 349 with an adhesive, but alternatively may be coupled using one or more fasteners, a weld operation, or any other suitable coupling technique.

Referring to FIGS. 14 and 15, bottom end portion 370, bottom end surface 372, and bottom edge 374 are offset from front sidewall 321. According to an exemplary embodiment, no supports (e.g. structures, members, spars, flanges, webs, etc.) extend from a bottom portion of front sidewall 321 to apron 340. Disconnecting the bottom of apron 340 from front sidewall 321 enables a portion the cabinet to fit between the apron and the basin. This enables apron 340 to be installed flush to a front face of the cabinet. Further this requires less precise cutting by an installer because the cut edges of the cabinet will be hidden from view.

Sink 300 may include one or more supports 382 (e.g. structures, members, spars, flanges, webs, etc.) which extend from a middle portion of front sidewall 321 to apron 340. According to an exemplary embodiment, sink 300 includes a first support, shown as left support 382*a*, and a second support, shown as right support 382*b*. According to the embodiment illustrated, first ends of left support 382*a* and right support 382*b* are coupled to apron 340 above bottom end portion 370, bottom end surface 372, and bottom edge 374. According to an exemplary embodiment, first ends of left support 382*a* and right support 382*b* are coupled to rear surface 349. According to an exemplary embodiment, second ends of left support 382*a* and right support 382*b* couple to front sidewall 321. According to another exemplary embodiment, second ends of left support 382*a* and right support 382*b* couple to left sidewall 322 and right sidewall 323, respectively. According to the embodiment illustrate, a second end of left support 382*a* wraps around a corner and couples to both front sidewall 321 and left sidewall 322, and a second end of right support 382*b* bends around a corner and couples to both front sidewall 321 and right sidewall 323. Left support 382*a* and right support 382*b* may be coupled to apron 340 and basin 301 in a variety of methods. According to an exemplary embodiment, left support 382*a* and right support 382*b* couple to apron 340 and basin 301 with an adhesive, but alternatively may be coupled using one or more fasteners, a weld operation, or any other suitable coupling technique.

Sink 300 may be formed of any suitably rigid material. Basin 301 and apron 340 may be formed of the same or different materials. Basin 301 and apron 340 may be one piece or may be constructed of several pieces coupled together (e.g., welded, stir-welded, soldered, sweated, joined, fastened, adhesively bonded, etc.). Basin 301 and apron 340 may be formed by any suitable means (e.g., stamping, casting, forging, bending, hammering, etc.). According to an exemplary embodiment, sink 300 is formed of stainless steel. According to an exemplary embodiment, sink 300 is formed of a single piece of 18 gauge, T-304 stainless steel.

Figure 16:
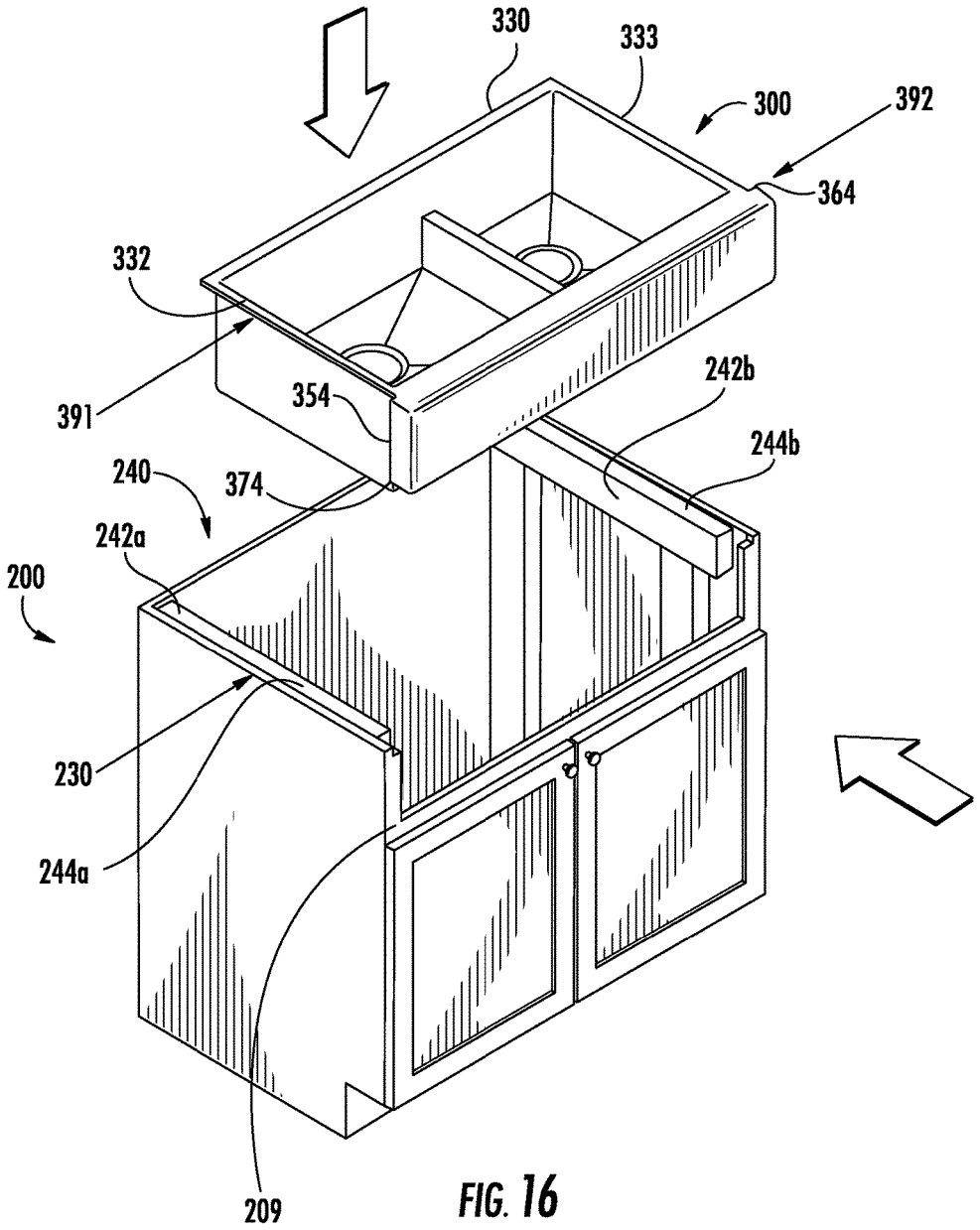
FIG. 16 is a perspective view schematic drawing of installing a sink into a cabinet, shown according to a second embodiment.
Figure 17:
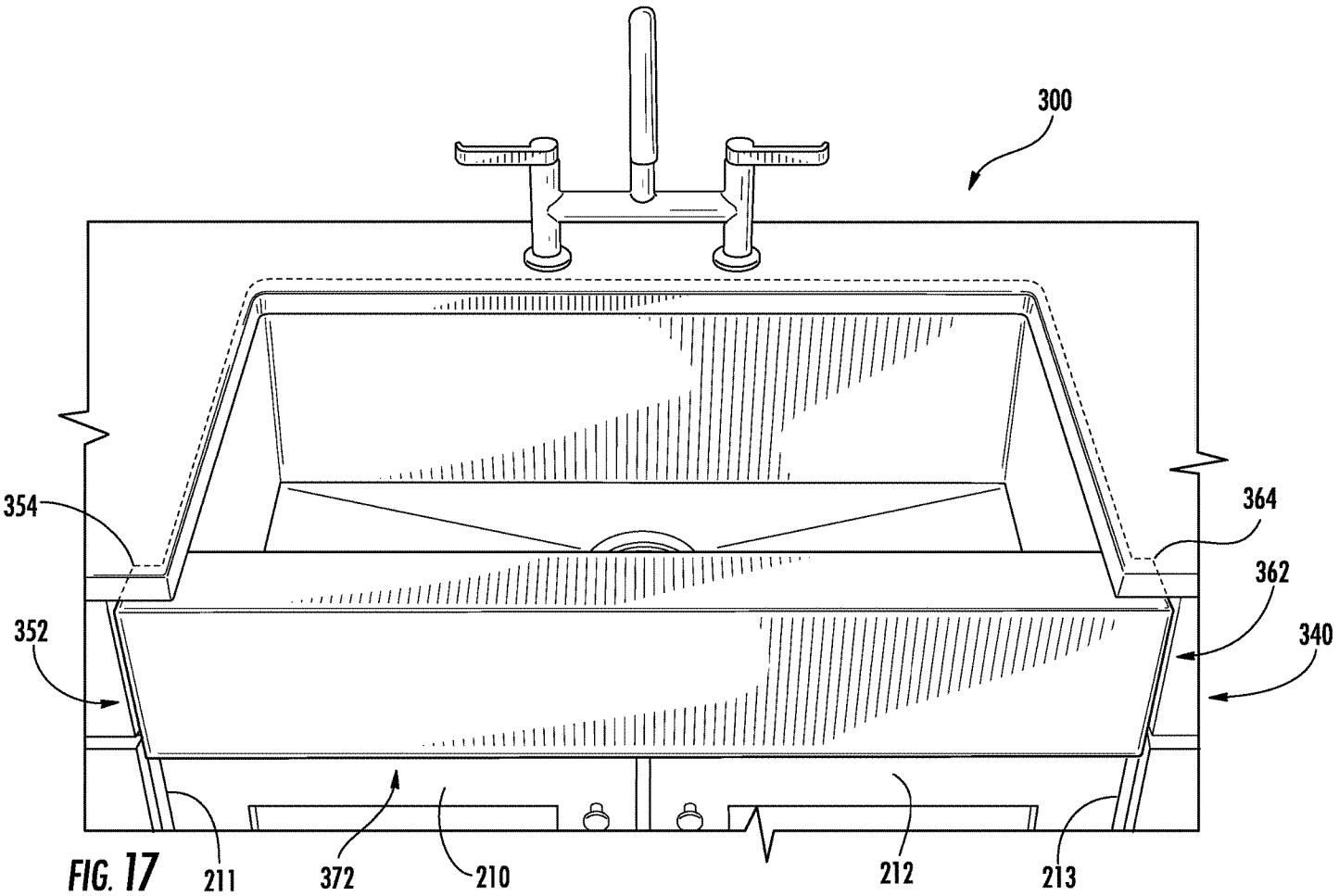
FIG. 17 is a front view of the sink of FIG. 12 installed in a cabinet, shown according to an exemplary embodiment.

The method of installing sink 300 onto a support structure, shown as a cabinet 200 in FIGS. 16 and 17 is substantially the same as the method detailed above with respect to the embodiment of FIGS. 1-6. As shown, sink 300 is a configured to be an under-mount sink. According to the various alternate embodiments, sink 300 may be installed such that rim 330 is above the countertop. According to an exemplary embodiment, the short apron configuration of sink 300 enables taller doors 210 and 212, enables non-apron-front height doors to be installed onto cabinet 200, and/or enables standard height doors to be installed below sink 300. According to another exemplary embodiment, the short apron configuration of sink 300 enables doors 210 and 212 to be the same height as adjacent doors. Enabling full height doors facilitates retrofitting sink 300 into pre-existing cabinetry. According to the embodiment illustrated, left end surface 352 and right end surface 362 of sink 300 are configured to substantially align with left vertical edge 211 and right vertical edge 213, respectively. As shown, bottom end surface 372 of sink 300 is configured to substantially align with bottom edges of adjacent drawers. According to an exemplary embodiment, apron 340 of sink 300 extends beyond drawer opening 214. According to the embodiment shown, the lateral distance from left end surface 352 to right end surface 362 is greater than a lateral width of drawer opening 214. As shown, bottom end surface 372 is below a bottom of drawer opening 214. The distance from left sidewall 322 to right sidewall 323 is narrower than the distance from left panel 202 to right panel 204. Further, according to the exemplary embodiment, the distance from left rim edge 136 to right rim edge 138 is configured to be less than the distance from left panel 202 to right panel 204. As such, modification of panels 202 and 204 is not required.

It is also important to note that the construction and arrangement of the elements of the sink as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. It should be noted that the elements and/or assemblies of the enclosure may be constructed from any of a wide variety of materials that provide sufficient strength or durability, in any of a wide variety of colors, textures, and combinations. Additionally, in the subject description, the word "exemplary" is used to mean serving as an example, instance or illustration. Any embodiment or design described herein as "exemplary" is not necessarily to be construed as preferred or advantageous over other embodiments or designs. Rather, use of the word exemplary is intended to present concepts in a concrete manner. Accordingly, all such modifications are intended to be included within the scope of the present inventions. Other substitutions, modifications, changes, and omissions may be made in the design, operating conditions, and arrangement of the preferred and other exemplary embodiments without departing from the spirit of the appended claims.

The order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the spirit of the appended claims.

What is claimed is:

1. An apron-front sink comprising:

a basin;

a rim located at an upper portion of the basin; and an apron offset from the basin and comprising a front member;

wherein the front member extends downward from the rim and laterally between a first end and an opposite second end;

wherein the first and second ends of the apron extend outwardly beyond the rim such that the apron is wider than the basin and the rim;

wherein the rim is the only portion of the apron-front sink extending from the basin to the apron; and wherein the apron has a height in a range of 6 inches to 7 inches, inclusive.

2. The sink of claim 1, wherein the apron further comprises a bottom member extending from a lower portion of the front member toward the basin.

3. The sink of claim 2, wherein the bottom member includes a rear edge that abuts a front face of a cabinet when the sink is installed thereto.

4. The sink of claim 2, wherein the bottom member is coupled to the first end and the second end of the apron to provide a continuous surface transition.

5. The sink of claim 1, wherein the first end of the apron and the second end of the apron at least partially overlap a front face of a cabinet on which the sink is supported.

6. The sink of claim 1, wherein the rim extends outwardly in a substantially horizontal direction to define a continuous planar surface configured to be mounted next to an underside of a countertop.

7. The sink of claim 1, wherein there is a gap between a front portion of the basin and the apron for receiving a portion of a cabinet.

8. The sink of claim 1, wherein the apron the basin has a height that is substantially the same as the height of the apron.

9. The sink of claim 1, further comprising a beam coupled to a rear surface of the front member and configured to provide reinforcement to the apron.

10. The sink of claim 1, wherein the first and second ends of the apron each include a generally planar side surface oriented substantially perpendicular to the front member of the apron.

11. An undermount, apron-front sink comprising:

a basin;

a rim extending outwardly from an upper portion of the basin and configured to be mounted adjacent an underside of a countertop; and an apron spaced apart from the basin and including a front member extending downward from the rim and laterally between a first end and an opposite second end;

wherein the first end of the apron and the second end of the apron extend laterally past the rim and overlap a portion of a front surface of a cabinet so as to conceal a cut line made in the cabinet;

wherein the rim couples the apron to the basin without any other supports; and wherein the apron has a height in a range of 6 inches to 7 inches, inclusive.

12. The sink of claim 11, wherein the rim forms a continuous planar surface, and wherein the front member is planar.

13. The sink of claim 11, further comprising a bottom flange extending from a lower portion of the front member toward the basin, wherein the bottom flange includes a rear edge that is coplanar with a rear edge of the first end of the apron and a rear edge of the second end of the apron such that the bottom flange of the apron engages the front surface of the cabinet when the rim is mounted adjacent the countertop.

14. The sink of claim 11, wherein there is a space between a front portion of the basin and the apron under the rim for receiving a portion of the cabinet.

15. The sink of claim 11, wherein the sink is made from stainless steel.

16. An undermount, apron-front sink comprising:

a basin including at least one sidewall;

an apron spaced apart from the basin and comprising a front member having a left end and a right end; and a rim coupling the apron to the at least one sidewall, wherein the rim is configured to be mounted adjacent an underside of a countertop;

wherein the front member extends laterally between the left and right ends to at least partially cover at least a portion of a front wall of a cabinet;

wherein the left and right ends of the apron extend laterally past the rim to define outermost side portions of the sink;

wherein the rim is the only portion of the apron-front sink extending from the basin to the apron; and wherein the apron has a height in a range of 6 inches to 7 inches, inclusive.

17. The sink of claim 16, wherein the apron further comprises a bottom member extending from a lower portion of the front member toward the basin.

18. The sink of claim 17, wherein the bottom member includes a rear edge that is coplanar with a rear edge of the left end of the apron and a rear edge of the right end of the apron, such that the bottom member of the apron engages a front surface of a cabinet when the rim is mounted adjacent the countertop.

19. The sink of claim 18, wherein the rear edges of the first and second ends of the apron are substantially parallel with and abut the front-surface of the cabinet.

* * * * *